United States Patent [19]

Sakai et al.

[11] Patent Number: 4,491,506

[45] Date of Patent: Jan. 1, 1985

[54] PROCESS AND APPARATUS FOR THE CONTINUOUS ELECTROLYTIC TREATMENT OF A METAL STRIP USING HORIZONTAL ELECTRODES

[75] Inventors: Kango Sakai; Hirohumi Nakano, both of Kitakyushu, Japan

[73] Assignee: Nippon Steel Corporation, Tokyo, Japan

[21] Appl. No.: 463,835

[22] Filed: Feb. 4, 1983

[30] Foreign Application Priority Data

Feb. 10, 1982 [JP] Japan ..... 57-18836
Nov. 9, 1982 [JP] Japan ..... 57-195361

[51] Int. Cl.[3] ..... C25D 7/06
[52] U.S. Cl. ..... 204/28; 204/206
[58] Field of Search ..... 204/28, 206–211

[56] References Cited

U.S. PATENT DOCUMENTS 4,119,516 10/1978 Yamaguchi ..... 204/244 R
4,183,799 1/1980 Sellitto et al. ..... 204/206
4,267,024 5/1981 Weiskopf ..... 204/15

*Primary Examiner*—G. L. Kaplan
*Assistant Examiner*—William T. Leader
*Attorney, Agent, or Firm*—Kenyon & Kenyon

[57] ABSTRACT

Electrolytic treatment of a metal strip with an electrolytic treating liquid carried out using an apparatus comprising a device for feeding the metal strip; a device for delivering the metal strip, which device is arranged downstream the feeding device in such a manner that a horizontal path of movement of the steel strip is provided between the feeding and delivering devices; a pair of electrode devices spaced from and facing each other through the horizontal path of the metal strip and each extending in parallel to the horizontal path, each electrode device having an electrode and static pressure liquid pad located in the electrode, each static pressure liquid pad being provided with a slit nozzle for ejecting an electrolytic treating liquid toward the corresponding metal strip surface under conditions adequate for producing a static pressure of the electrolytic treating liquid ejected therethrough between each electrode device and the corresponding metal strip surface to an extent that the metal strip is supported in the horizontal path thereof; a source for supplying the electrolytic treating liquid to each slit nozzle; and a device for applying voltage between the electrodes and metal strip. The apparatus is characterized in that an additional slit nozzle is arranged at each of the entrance ends and the exit ends of the pair of electrode devices, each additional slit nozzle being directed to the corresponding metal strip surface and being connected to said electrolyte-supplying source, whereby streams of the electrolytic treating liquid ejected through the slit nozzles are confirmed in the spaces between the electrode devices and the metal strip by the streams of the electrolytic treating liquid ejected through the additional slit nozzles.

26 Claims, 43 Drawing Figures

Fig. 18A-(a)
PRIOR ART
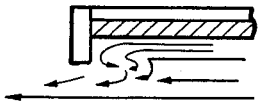
Fig. 18B-(a)
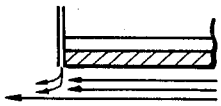
Fig. 18A-(b)
PRIOR ART
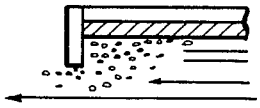
Fig. 18B-(b)
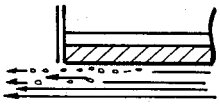
Fig. 18A-(c)
PRIOR ART
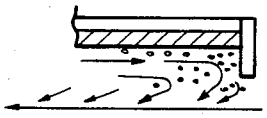
Fig. 18B-(c)
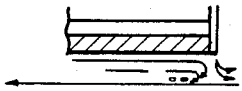

PROCESS AND APPARATUS FOR THE CONTINUOUS ELECTROLYTIC TREATMENT OF A METAL STRIP USING HORIZONTAL ELECTRODES

FIELD OF THE INVENTION

The present invention relates to a process and apparatus for the continuous electrolytic treatment of a metal strip using horizontal electrodes.

Particularly, the present invention relates to a process and apparatus for the continuous electrolytic treatment of a metal strip with an electrolytic treating liquid at a high current density while the metal strip passes through a treating space formed between a pair of horizontal electrodes.

More particularly, the present invention relates to a process and apparatus for the continuous electrolytic treatment of a metal strip with an electrolytic treating liquid at a high current density under a relatively low voltage, while the metal strip passes at a high velocity through a treating space formed between a pair of horizontal electrodes arranged close to each other, the electrolytic treating liquid being ejected into the treating space so as to create a static pressure therein to an extent that the metal strip is supported in the horizontal path thereof, the flows of the electrolytic treating liquid in the treating space being controlled, and the resultant product having substantially no defects.

DESCRIPTION OF THE PRIOR ART

It is known that a metal strip can be continuously treated with an electrolytic treating liquid while moving the metal strip horizontally through a treating space formed between a pair of horizontal electrodes, by flowing the electrolytic treating liquid through the treating space and by applying a voltage between the electrodes and the metal strip.

It is also known that, generally, in order to produce an electrolytically plated product having a high quality at a high efficiency, it is required that the deposit of metal to be plated be carried out at a high current density under a low voltage.

In electrolytic treatment, the current density can be made large by increasing the critical current density of the electrolytic treatment system. The critical current density is regulated in accordance with the following equation (1):

$$id = nFD(C/\delta) \quad (1)$$

wherein id represents a critical current density ($A/cm^2$), n represents the valence of metal ions, F represents Faraday's constant, D represents a diffusion coefficient ($cm^2/sec$) of the metal ions, C represents a concentration of the metal ions, and $\delta$ represents a thickness of the diffusion layer.

The critical current density can be increased by increasing the concentration C of the metal ions or by elevating the temperature of the treating liquid.

It is known that the thickness $\delta$ of the diffusion layer can be decreased by an increased velocity of relative movement of the electrolytic treating liquid to the metal strip surface, for example, as a result of agitating the liquid or by increasing the flow velocity of the liquid. Accordingly, in order to obtain a satisfactory current density, it is desirable to provide an electrolytic treatment apparatus in which the treating liquid can flow on the entire surface of the metal strip at a uniform, high flow velocity.

Also, in electrolytic treatment, the voltage generated between electrodes is calculated in accordance with the following equation (2):

$$V_T = V_d + V_s + V_1 + V_g \quad (2)$$

wherein $V_T$ represents a total voltage between a pair of electrodes; $V_d$ represents a decomposition voltage; $V_s$ represents a voltage due to the resistance $R_s$ of the metal strip, this voltage $V_s$ being proportional to the effective distance L between a conductor roll and an anode, that is, $V_s = I \cdot R_s \cdot L$, wherein I represents an intensity of electric current $V_1$ represents a voltage due to the resistance $R_e$ of the treating liquid, this voltage $V_1$ being proportional to the distance H between the electrodes, that is, $V_1 = I\ R_e\ H$ wherein I is the same as above; and $V_g$ represents a voltage generated due to gas collected in the treating liquid.

From equation (2), it is taught that in the control of the total voltage $V_T$, the values of the voltage $V_s$ generated due to the resistance of the metal strip, the voltage $V_1$ generated due to the resistance of the treating liquid, and the voltage $V_g$ generated due to the collected gas in the treating gas should be considered. That is, in order to carry out the electrolytic treatment under a low voltage, it is important that the distance between the electrode be made as small as possible and the oxygen gas generated on the anode be removed as early as possible. The electrolytic treatment apparatus should be designed so that the above-mentioned important items are attained.

In conventional horizontal type electrolytic treatment apparatus, the metal strip which is moving horizontally is subject to the load not only of its weight but also of the weight of the treating liquid flowing on the upper surface of the metal strip. This phenomenon results in formation of catenary of the metal strip, which never occurs in a vertical type apparatus. The catenary of the metal strip limits how far the distance between each electrode and the corresponding metal strip surface can be reduced. The distance between each electrode and the corresponding metal strip surface must usually be at least 15 mm in conventional horizontal apparatus.

The conventional horizontal type apparatus is poorer in ease of removal of gas generated in the treating liquid than the vertical type apparatus. Therefore, in the conventional horizontal type apparatus, the gas generated in the treating liquid tends to be collected and to stay on the lower surface of the metal strip. Especially, in the case where the treating liquid flows in the opposite direction to that of movement of the metal strip, an increase in the velocity of the metal strip results in easier residence of the generated gas in the treating space and significantly more difficult removal of the gas from the treating space. Accordingly, when electrolytic treatment is carried out at a high current density by using the conventional horizontal type apparatus, not only does the total required voltage rapidly increase, but also the quality of the surfaces of the resultant product becomes uneven and poor to such an extent that the electrolytic treatment cannot be continued.

Also, when electrolytic treatment is carried out at a high current density by using the conventional horizontal type apparatus, undesirable burnt deposits are frequently produced on the treated surfaces of the metal strip. In order to prevent the burnt deposits, it is necessary to make the thickness of the diffusion layer small. Accordingly, by increasing the flow velocity of the treating liquid and by controlling the flows of the treating liquid on the whole surface of the metal strip to be uniform, not only can the burnt deposits be prevented, but also the gas generated in the treating liquid can be rapidly removed from the treating liquid. Accordingly, a rapid increase in the total required voltage can be prevented.

However, when the conventional horizontal type electrolytic treatment apparatus is used, the control of the flow velocity of the treating liquid is not always satisfactory.

Under the above-mentioned circumstances, a new process and apparatus capable of eliminating all the defects of the conventional processes and apparatuses are greatly desired by the electrolytic treatment industry.

SUMMARY OF THE INVENTION

An object of the present invention is to provide a process and apparatus for the continuous electrolytic treatment of a metal strip using horizontal electrodes at a high current density at a high speed without causing a rapid increase in required voltage.

Another object of the present invention is to provide a process and apparatus for the continuous electrolytic treatment of a metal strip using horizontal electrodes where the metal strip moves very close to electrodes, the current density is high, the velocity of the metal strip is high, and the catenary of the moving metal strip is very small.

Still, another object of the present invention is to provide a process and apparatus for the continuous electrolytic treatment of a metal strip using horizontal electrodes at a high current density at a high velocity of the metal strip where an electrolytic treating liquid flows uniformly over the entire surface of the metal strip.

A further object of the present invention is to provide a process and apparatus for the continuous electrolytic treatment of a metal strip using horizontal electrodes at a high current density at a high velocity of the metal strip while preventing formation of undesirable burnt deposits and other defects on the treated metal strip surface.

The above-mentioned objects can be attained by the process and apparatus of the present invention. The process of the present invention for the continuous electrolytic treatment of a metal strip with an electrolytic treating liquid comprises the steps of:

introducing a metal strip along a horizontal path of movement thereof, into a narrow treating space formed between a pair of horizontal electrode devices spaced from and facing each other, each electrode device having an electrode and a static pressure liquid pad located in the electrode and each static pressure liquid pad being provided with a slit nozzle for ejecting therethrough an electrolytic treating liquid toward the corresponding metal strip surface;

ejecting streams of the electrolytic treating liquid through the slit nozzles toward the metal strip surfaces under conditions adequate for producing a static pressure of the electrolytic treating liquid between the electrode devices and the metal strip to an extend that the metal strip is supported in the horizontal path thereof; and applying voltage between the metal strip and the electrodes;

which process is characterized in that additional streams of the electrolytic treating liquid are ejected toward the metal strip surfaces, through additional slit nozzles located at the entrance ends and the exit ends of the pair of electrode devices and each extending in a direction lateral to the longitudinal direction of the horizontal path of movement of the metal strip, whereby the streams of the electrolytic treating liquid ejected from the slit nozzles are confined in the spaces between the electrode devices and the metal strip.

The above-mentioned process can be carried out by using the apparatus of the present invention, which comprises:

means for feeding a metal strip;

means for delivering the metal strip, which means is arranged downstream the feeding means in such a manner that a horizontal path of movement of the steel strip is provided between the feeding means and the delivering means;

a pair of electrode devices spaced from and facing each other through the horizontal path of the metal strip and each extending in parallel to the horizontal path, each electrode device having an electrode and static pressure liquid pad located in the electrode, each static pressure liquid pad being provided with a slit nozzle for ejecting therethrough an electrolytic treating liquid toward the corresponding metal strip surface, and the slit nozzle being adequate for producing a static pressure of the electrolytic treating liquid ejected therethrough between each electrode device and the corresponding metal strip surface to an extent that the metal strip is supported in the horizontal path thereof; a source for supplying the electrolytic treating liquid to each slit nozzle; and means for applying voltage between the electrodes and metal strip; and which apparatus is characterized in that an additional slit nozzle is arranged at each of the entrance ends and the exit ends of the pair of electrode devices, each additional slit nozzle being directed to the corresponding metal strip surface and being connected to the electrolytic treating liquid-supplying source.

BRIEF DESCRIPTION OF THE DRAWINGS

FIG. 18A-(a) is an explanatory view of flows of an electrolytic treating liquid in a location around an exit edge mask of a conventional apparatus;

FIG. 18A-(b) is an explanatory view of movement of bubbles in a location around an exit edge mask of a conventional apparatus;

FIG. 18A-(c) is an explanatory view of flows of an electrolytic treating liquid and movement of bubbles in a location around an entrance edge mask of a conventional apparatus;

FIG. 18B-(a) is an explanatory view of flows of an electrolytic treating liquid in a location around an exit additional slit nozzle in the apparatus of the present invention;

FIG. 18B-(b) is an explanatory view of movement of bubbles in a location around an exit additional slit nozzle in the apparatus of the present invention;

FIG. 18B-(c) is an explanatory view of flows of an electrolytic treating liquid in a location around an entrance additional slit nozzle in the apparatus of the present invention;

DETAILED DESCRIPTION OF THE INVENTION

For the purpose of fully understanding the present invention, some examples of the prior arts will be illustrated below.

U.S. Pat. No. 4,310,403 discloses an apparatus for the continuous electrolytic treatment of a metal strip with an electrolytic treating liquid, in which apparatus the metal strip is supported between a pair of horizontal static pressure liquid pads facing each other. This type of apparatus is indicated in FIGS. 1A and 1B.

Figure 1A:
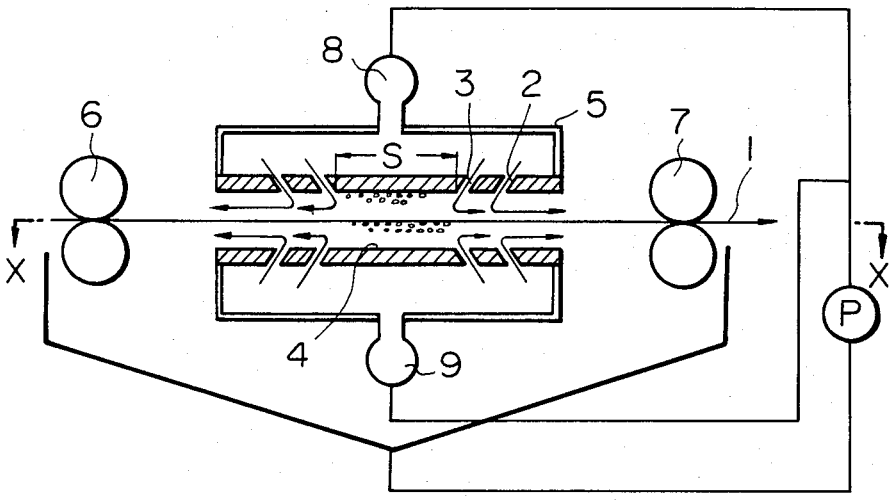
Fig. 1A PRIOR ART
FIG. 1A is an explanatory lateral cross-sectional view of a known apparatus (prior art) for electrolytically treating a metal strip.
Figure 1B:
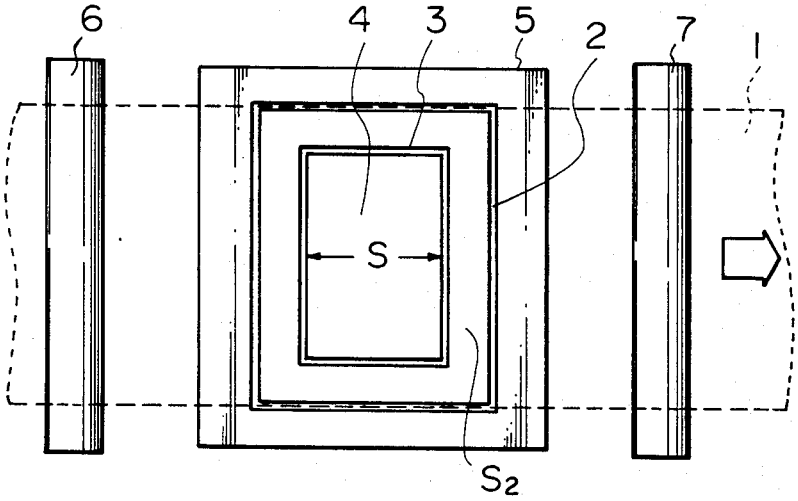
Fig. 1B PRIOR ART
FIG. 1B is an explanatory horizontal cross-sectional view of the known apparatus indicated in FIG. 1A, along line X—X in FIG. 1A.

Referring to FIGS. 1A and 1B, a metal strip 1 moves from a pair of feeding rolls 6 to a pair of delivering rolls 7 through a pair of static pressure liquid pads 5. Streams of an electrolytic treating liquid are ejected through slits 2 and 3 formed in the electrodes 4 toward the surfaces of the metal strip.

The form and location of the slits 2 and 3 are shown in FIG. 1B. That is, each of the slits 2 and 3 is in the form of a closed rectangular channel formed in the electrode 4. The treating liquid is supplied to upper and lower heads 8 and 9 by means of a pump and is ejected toward the upper and lower surfaces of the metal strip 1 through the slits 2 and 3. In this case, the ejected upper and lower streams of the treating liquid create static pressures between the upper and lower electrodes 4 and the metal strip 1 so as to stably support the metal strip. Accordingly, electrolytic treatment can be applied to the metal strip located close to the electrode surfaces.

When the apparatus indicated in FIGS. 1A and 1B is arranged vertically, the electrolytic treating liquid ejected through the slits can fall down freely due to gravity and gas generated during the electrolytic treatment can be easily removed due to its buoyancy. Therefore there occurs no problems in flowing the electrolytic treating liquid and in removing the gas. When the apparatus is arranged horizontally as indicated in FIG. 1A, a portion of the treating liquid ejected through the slits tends to be confined in the space surrounded by the rectangular slits. This phenomenon results in uneven flow of the treating liquid. Also, the phenomenon results in undesirable confinement of the gas in the space surrounded by the slits. Accordingly, although the metal strip can be stably supported by the static pressure, the supply of the electrolyte to the metal strip surfaces is carried out unevenly and the removal of the gas is unsatisfactory. Therefore, the quality of the treated product is not always satisfactory.

In the apparatus indicated in FIGS. 1A and 1B, the distance S between a pair of segments of the slit 3 extending at right angles to the direction of movement of the metal strip 1 is smaller than that of another conventional horizontal type apparatus. If the distance S is made large to the same extent as that of the another conventional apparatus, the large distance S results in promotion of the above-mentioned defects. The defects sometime make continuation of the electrolytic treatment impossible.

If the apparatus indicated in FIGS. 1A and 1B is modified so that a pair of static pressure liquid pads having slits are formed in the longitudinal center portion of the electrode and the length of the electrodes is made long, a portion of the metal strip moving through the long treating space can be supported only at a location between the pads. Therefore, the support of the long portion of the metal strip becomes unstable and unsatisfactory and the control of flows of the treating liquid becomes difficult.

Japanese Examined Patent Publication (Kokoku) No. 50-8020 discloses another process for the continuous electrolytic treatment of a metal strip. In this process the metal strip is moved along a horizontal path provided between horizontal upper and lower electrodes and the electrolytic treating liquid is passed concurrently with the movement of the metal strip. This type of process can be carried out by using the apparatus indicated, for example, in FIG. 2.

Figure 2:
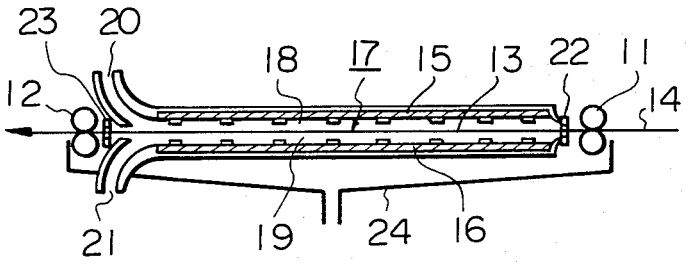
Fig. 2 PRIOR ART
FIG. 2 is an explanatory longitudinal cross-sectional view of another known apparatus (prior art) for electrolytically treating a metal strip.

Referring to FIG. 2, a pair of feeding rolls 11 and a pair of delivering rolls 12 are arranged so that a horizontal path 13 along which a metal strip 14 is moved is provided between the feeding rolls 11 and the delivering rolls 12.

Upper and lower electrodes 15 and 16 are arranged respectively above and below the path 13 of movement of the metal strip 14, between the feeding rolls 11 and the delivering rolls 12, so as to form a treating space 17 between the upper and lower electrodes 15 and 16. The treating space 17 is divided into horizontal upper and lower gaps 18 and 19 by the horizontal path of movement 13 of the metal strip 14. The horizontal upper and lower gaps 18 and 19 are connected to a source (not shown in FIG. 2) of supply of an electrolytic treating liquid to be applied to the metal strip 14, though upper and lower slits 20 and 21, which slits are located beside the delivering rolls 12 and inclined to the downstream side of the apparatus.

The upstream end of the treating space 17 is defined by upstream sealing rubber plates 22. The downstream end of the treating space 17 is defined by a pair of downstream sealing rubber plates 23. Accordingly, when the electrolytic treating liquid is fed into the upper and lower gaps 8 and 9 through the slits 20 and 21, respectively, the electrolytic treating liquid in each gap flows countercurrently with movement of the metal strip 14. A portion of the electrolytic treating liquid flows out from the treating space 17 through the openings between the upstream sealing plates 22 and between the downstream sealing plates 23 and is collected by a funnel-shaped collector 24.

In the above-mentioned method, the electrolytic treating liquid flows through a relatively long length of the horizontal gaps only countercurrently with movement of the metal strip. Therefore, during the treating procedure, the surfaces of the electrodes are partially covered by bubbles of gas, for example, oxygen gas, generated from the electrolytic reaction occurring in the treating space. This phenomenon remarkably hinders the flow of the electric current between the electrodes and the metal strip and, therefore, the result of the electrolytic treatment is unsatisfactory. Also, when the above-mentioned method is carried out at a high speed of the metal strip, for example, 150 m/min or more, it is necessary to apply the electric current at a high density to the electrolytic treating system. This high current density frequently results in undesirable generation of burnt deposits on the treated metal strip.

Japanese Examined Patent Publication (Kokoku) No. 51-32582 discloses a similar apparatus to that indicated in FIG. 2, except that the inclined upper and lower slits are located in the middle portion of the electrodes. In this type of apparatus, a stream of the electrolytic treating liquid is spouted into the upstream half portion of the corresponding gap countercurrently with movement of the metal strip.

A portion of the spouted electrolytic treating liquid is carried by the metal strip through the downstream half portion of the gap.

In the above-mentioned type of apparatus, it was found that gas bubbles, for example, oxygen gas bubbles formed on the surfaces of the electrodes due to the electrolytic reactions occurring in the electrolytic treating system, cannot be satisfactorily removed by the flows of the electrolytic treating liquid.

Japanese Unexamined Patent Publication (Kokai) No. 57-101692 discloses an improved horizontal type apparatus for the electrolytic treatment of the metal strip.

Figure 3:
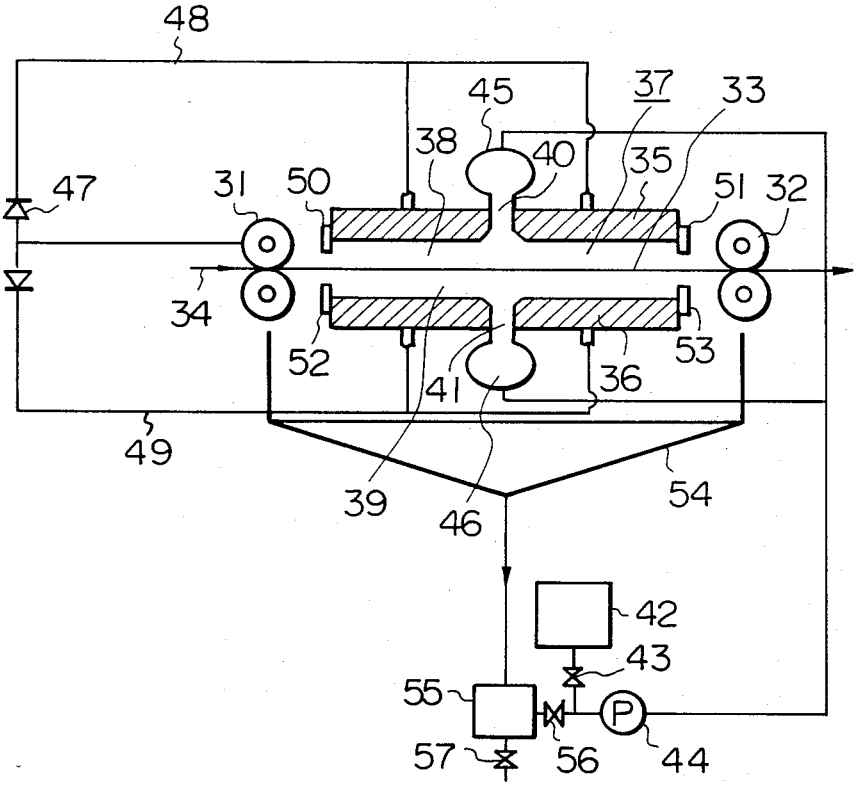
Fig. 3 PRIOR ART
FIG. 3 is an explanatory lateral cross-sectional view of still another apparatus of a prior art for electrolytically treating a metal strip.

Referring to FIG. 3 which shows an explanatory cross-sectional profile of the above-mentioned prior apparatus, feeding means comprising a pair of feeding rolls 31 and delivery means comprising a pair of delivering rolls 32 are arranged in such a manner that a horizontal path 33 along which a metal strip 34 can move horizontally is provided between the feeding rolls 31 and the delivering rolls 32.

Upper and lower electrode devices 35 and 36 are arranged, respectively, above and below the path of movement 33 of the metal strip 34 between the feeding rolls 31 and delivering rolls 32. Accordingly, a treating space 37 is formed between the upper and lower electrode devices 35 and 36. Also, where the metal strip 34 passes through the treating space 37, the treating space 37 is divided into a pair of horizontal upper and lower gaps 38 and 39 by the metal strip 34.

The electrode devices 35 and 36 are provided with a pair of upper and lower slits 40 and 41 for feeding the electrolytic treating liquid into the horizontal gaps 38 and 39, respectively. Each of the upper and lower slits 40 and 41 is formed in the middle portion of the corresponding electrode device 35 or 36 in such a manner that the slit 40 or 41 horizontally extends across the electrode device 35 or 36 at substantially right angles to the direction of movement of the metal strip 34 and is vertically directed to the corresponding gap 38 or 39 at substantially right angles to the horizontal path of the movement 33 of the metal strip 34.

That is, the feeding end of each slit 40 or 41 opens to the horizontal gap 38 or 39. The other end of each slit is connected to a supply source tank 42 of the electrolytic treating liquid through a valve 43, a pump 44, and a header 45 or 46 which is located just upstream of the slit 40 or 41.

The upper and lower electrodes 35 and 36 are connected to a power source 47. Also, the metal strip 34 can be connected to the power source 47 through the feeding rolls 31. Accordingly, when voltage is applied between each of the electrode devices 35 and 36 and the metal strip 34, an electric current flows between each of the electrode device 35 and 36 and the metal strip 34 through the electrolytic treating liquid filled in the corresponding gap.

The upstream end and the downstream end of the upper gap 38 are defined by an upstream sealing plate 50 and a downstream sealing plate 51, respectively. The upstream end and the downstream end of the lower gap 39 are defined by an upstream sealing plate 52 and a downstream sealing plate 53.

When electrolytic treatment is carried out by using the apparatus indicated in FIG. 3, the steel strip 34 is fed into the apparatus by means of the feeding rolls 31, horizontally moves through the narrow treating space 37 at a predetermined speed, and is delivered from the apparatus by means of the delivering rolls 32.

The electrolytic treating liquid is fed from the supply source tank 42 into the upper and lower heads 45 and 46 through the valve 43 by means of the pump 44 under pressure. The electrolytic treating liquid is uniformly fed under pressure from the upper and lower heads 45 and 46, respectively, into the upper and lower gaps 38 and 39 through the upper and lower vertical slits 40 and 41.

That is, each stream of the electrolytic treating liquid is spouted vertically into the corresponding gap, and then, is divided into two opposite flows. One flow is concurrent with movement of the metal strip. The other flow is countercurrent with movement of the metal strip. Accordingly, the flows of the electrolytic treating liquid in the upper and lower gaps in the apparatus indicated in FIG. 3 are smoother than that in the apparatus indicated in FIG. 2 wherein the electrolytic treating liquid flows countercurrent to the movement of the metal strip. Therefore, the apparatus indicated in FIG. 3 allows the electrolytic treatment to be carried out at a high current density and, therefore, is highly valuable.

The apparatus indicated in FIG. 3 is, however, not always satisfactory in preventing undesirable catenary of the metal strip and in controlling the flow velocity of the electrolytic treating liquid.

In the conventional horizontal type apparatus, the catenary of the metal strip is generated due to the weight of the metal strip and the electrolytic treating liquid on the metal strip. In the apparatus indicated in FIG. 3, when the upper and lower streams are spouted vertically through the upper and lower vertical slits located in the center portions of the upper and lower electrodes toward the upper and lower surfaces of the metal strip, respectively, even if the flow rate or pressure of the lower stream is controlled larger than that of the upper stream for the purpose of decreasing the catenary of the metal strip, the resultant decrease in the catenary is unsatisfactory and the support of the metal strip by the streams of the electrolytic treating liquid becomes unsatisfactory. Therefore, in this case, the catenary of the metal strip can be reduced only by increasing the tension applied to the metal strip.

Also, in the apparatus indicated in FIG. 3, the increase in the moving velocity of the metal strip results in increased difficulty of balancing the countercurrent flows with the concurrent flows of the electrolytic treating liquid to the movement of the metal strip. That is, when the metal strip is moved at a high velocity, the influence of viscosity of the electrolytic treating liquid on flowing thereof on the metal strip surfaces becomes large. That is, in portion of the treating gaps in which the electrolytic treating liquid flows concurrently to the movement of the metal strip, the supply of the electrolyte (metal ions) and the removal of gas can be smoothly carried out. However, in another portions of the treating gaps in which the electrolytic treating liquid flows countercurrently to the movement of the metal strip, the supply of the electrolyte and the removal of gas become poor with increase in the moving velocity of the metal strip.

In the apparatus of the present invention, a static pressure liquid pad for feeding an electrolytic treating liquid is arranged in each electrode device, and additional slit nozzles for ejecting the electrolytic treating liquid are arranged in the entrance and exit ends of each electrode device. The directions of the slit nozzles in the static pressure liquid pads can be varied in consideration of the velocity of the metal strip, if necessary. The process and apparatus of the present invention are effective for eliminating or decreasing the disadvantages and defects of the conventional processes and apparatuses.

Referring to FIGS. 4, 5, 6, and 7, a horizontal path 63 of movement of a metal strip 64 is provided between a pair of feeding rolls 61 and a pair of delivering rolls 62.

Upper and lower electrode devices 65 and 66 are arranged, respectively, above and below the path 63 of movement of the metal strip 64 between the feeding rolls 61 and delivering rolls 62. Accordingly, a treating space 67 is formed between the upper and lower electrode devices 65 and 66. Also, when the metal strip 64 passes through the treating space 67, the treating space 67 is divided into a pair of horizontal upper and lower gaps 68 and 69 by the metal strip 64.

The thickness of the gaps are variable depending on the type of the electrolytic treatment and the feeding rate of the electrolytic treating liquid. Usually, it is preferable that the thickness of the upper and lower gaps 68 and 69 be 30 mm or less. However, in the case where it is intended to carried out the electrolytic treatment at a high current density, it is preferable that the thickness of the gaps be as small as possible. In order to exhibit fully the advantages of the present invention, it is more preferable that the thickness of the gaps be 15 mm or less, still more preferably, 7 mm or less.

If the thickness of the gaps is more than 30 mm, sometimes it becomes difficult to fill the gaps with the flow of the electrolytic treating liquid. Also, it is difficult to make the flow rate of the electrolytic treating liquid uniform over the surfaces of the metal strip. If the flow rate is not uniform, the electrolytic treatment on the metal strip becomes uneven.

Each of the electrode devices 65 and 66 comprises at least one horizontal electrode substantially insoluble in the electrolytic treating liquid to be applied to the metal strip. In the apparatus indicated in FIG. 4, each electrode device comprises a single electrode.

The electrode devices 65 and 66 are provided with a pair of upper and lower static pressure liquid pads 70 and 71 for feeding the electrolytic treating liquid into the horizontal gaps 68 and 69, respectively.

The feeding end of each static pressure liquid pads 70 or 71 opens to the horizontal gap 68 or 69. The other end of each pad is connected to a supply source tank 72 of the electrolytic treating liquid through a valve 73, a pump 74, and a header 75 or 76 which is located just upstream of the pad 70 or 71.

The upper and lower electrodes 65 and 66 are connected to a power source 77. Also, the metal strip 64 can be connected to the power source 77 through the feeding rolls 61. Accordingly, when voltage is applied between each of the electrode devices 65 and 66 and the metal strip 64, an electric current flows between each of the electrode devices 65 and 66 and the metal strip 64 through the electrolytic treating liquid filled in the corresponding gap.

The upper and lower pads 70 and 71 are provided with slit nozzles 89*a* and 89*b* for ejecting therethrough an electrolytic treating liquid and for producing static pressure on the upper and lower surfaces of the metal strip 64, respectively.

Upper and lower static pressure liquid pads 70 and 71 are arranged in the longitudinal middle portions of the upper and lower electrode devices 65 and 66, respectively. The upper and lower pads 70 and 71 are spaced from and face each other through the horizontal path 63 of the metal strip 64. The upper and lower pads 70 and 71 may be movable up and down separately from the upper and lower electrodes 65 and 66, respectively, so as to control the distance between the pads and the corresponding metal strip surface. The additional slit nozzles 80, 81, 82, and 83 are connected to the supply source tank 72 of the electrolytic treating liquid respectively through additional heads 92, 93, 94, and 95 which are located just upstream of the corresponding additional slit nozzles.

Figure 4:
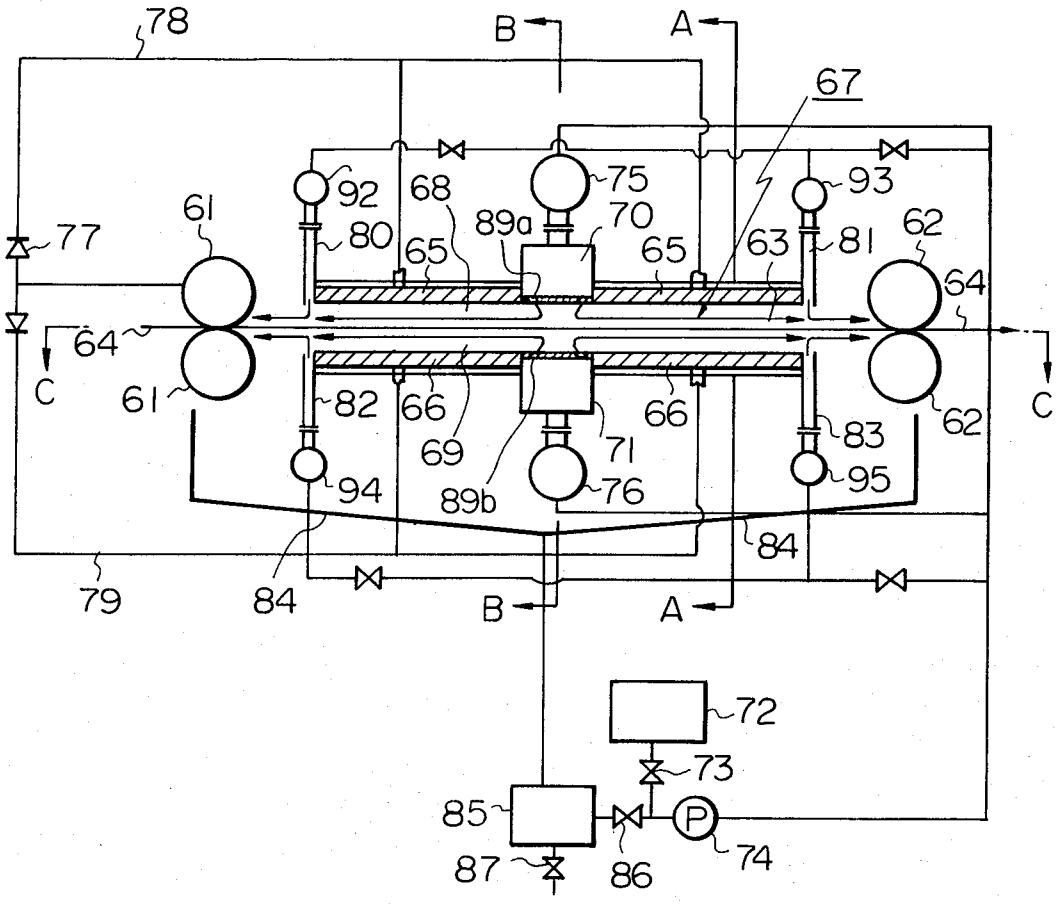
FIG. 4 is an explanatory longitudinal cross-sectional view of an embodiment of the apparatus of the present invention.

When the method of the present invention is carried out by using the apparatus indicated in FIG. 4 the steel strip 64 is fed into the apparatus by means of the feeding rolls 61, horizontally moves through the narrow treating space 67 at a predetermined speed, for example, from 150 to 300 m/min, and, finally, is delivered from the apparatus by means of the delivering rolls 62.

A portion of the electrolytic treating liquid is fed from the supply source tank 72 into the upper and lower heads 75 and 76 through the valve 73 by means of the pump 74 under pressure. The portion of the electrolytic treating liquid is uniformly fed under pressure from the upper and lower heads 75 and 76, respectively, into the upper and lower gaps 68 and 69 through the upper and lower vertical slits 89*a* and 89*b*.

That is, each stream of the electrolytic treating liquid is spouted vertically into the corresponding gap, and, then, is divided into two opposite flows. One flow is concurrent with movement of the metal strip. The other flow is countercurrent with movement of the metal strip. Another portion of the electrolytic treating liquid is supplied to additional heads 92, 93, 94, and 95 and is ejected through the additional slit nozzles 80, 81, 82, and 83.

The streams of the electrolytic treating liquid ejected through the additional slit nozzles are effective for sealing the longitudinal flows of the electrolytic treating liquid ejected through the slit nozzles of the static pressure liquid pads.

When the electrolytic treatment is applied to the metal strip in accordance with the process and apparatus of the present invention, the metal strip can be stably supported in the horizontal path thereof by the static pressures created thereon by the streams of the treating liquid ejected through the static pressure liquid pads. Therefore, the catenary of the metal strip is very small. This feature allows the distance between the electrode devices and the metal strip to be very short. Also, the flow velocities of the concurrent flows and countercurrent flows of the electrolytic treating liquid in the narrow treating gaps can be controlled to be equal to each other. Therefore, the supply of the electrolyte to the metal strip and the removal of gas generated in the treating liquid can be easily effected.

The specific features and advantages of the present invention will be further illustrated below.

Figure 5:
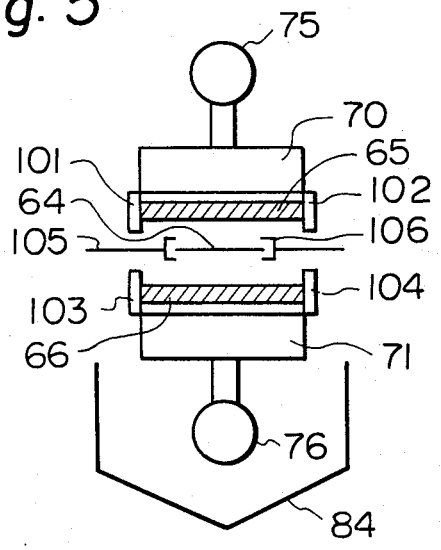
FIG. 5 is an explanatory lateral cross-sectional view of the apparatus indicated in FIG. 4, along line A—A in FIG. 4.
Figure 6:
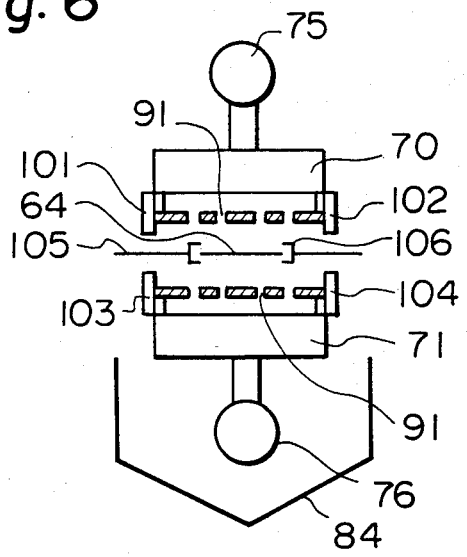
FIG. 6 is an explanatory lateral cross-sectional view of the apparatus indicated in FIG. 4, along line B—B in FIG. 4.

Referring to FIGS. 5 and 6, which show the lateral cross-sections along line A—A and line B—B, respectively, of the apparatus indicated in FIG. 4, lateral edge ends of the upper and lower electrode devices are provided with means for restricting lateral flows of the electrolytic treating liquid from the treating space. The restricting means may be edge plates 101, 102, 103, and 104 projecting from the lateral edges of the electrode devices 65 and 66 toward the horizontal path of the metal strip 64.

The lateral edges of the electrode devices may be free from restriction means such as the edge plates. Also, the edge plates 101 and 103 facing each other and the edge plates 102 and 104 facing each other may be connected to each other, respectively. In this case, each lateral side of the treating space is defined by a side wall.

The edge plates may be replaced by further additional slit nozzles for ejecting vertically a portion of the electrolytic treating liquid toward the horizontal path of the metal strip. The vertical streams ejected from the treating liquid are effective for restricting the lateral flow of the treating liquid.

Referring to FIGS. 5 and 6, a pair of edge masks 105 and 106 may be arranged in the treating space between the electrode devices 65 and 66. The edge masks 105 and 106 each have a side mask member having a C-shaped cross-sectional profile and an arm member. The location of the side mask member is close to the corresponding side edge of the metal strip 64 and can be adjusted by moving it horizontally by using the arm member. The edge masks 105 and 106 are also effective for restricting the lateral flows of the electrolytic treating liquid in the treating space.

Figure 7:
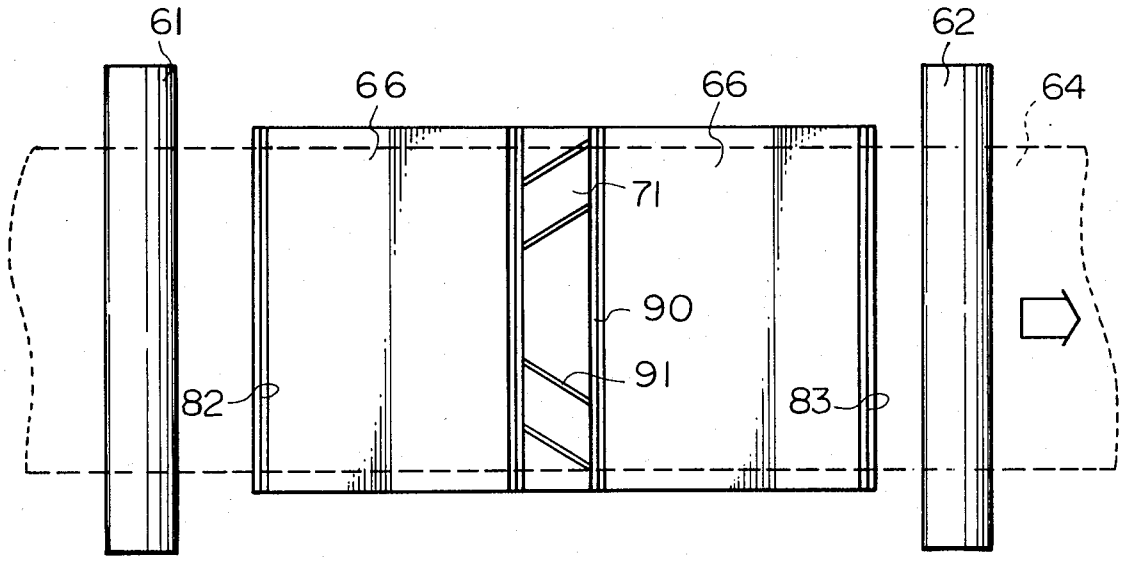
FIG. 7 is an explanatory horizontal cross-sectional view of the apparatus indicated in FIG. 4, along line C—C in FIG. 4.

Referring to FIGS. 6 and 7, the lower static pressure liquid pad 71 is located in the approximate center of the electrode device 66 and is provided with a slit nozzle compsed of a pair of lateral segments 90 extending at right angles to the longitudinal direction of the horizontal path of the metal strip 64, and two pairs of longitudinal segments 91 through which the lateral segments 90 are connected to each other. The longitudinal segments 91 extend at angles to the longitudinal direction of the horizontal path of the metal strip 64. The slit nozzle contains three closed channels and, therefore, can form three spaces surrounded by vertical curtains consisting of the streams of the electrolytic treating liquid so as to create static pressures in the surrounded spaces. The static pressures are effective for stably supporting the metal strip in the horizontal path thereof.

The additional slit nozzles 82 and 83 extend at approximately right angles to the longitudinal direction of the horizontal path of the metal strip 64.

The forms, intervals, directions, and thickness of the slits formed in the static pressure liquid pad are variable in consideration of the purpose of the apparatus.

The lateral and longitudinal segments 90 and 91 of the slits in the slit nozzle may be in the forms and the arrangements indicated in FIGS. 8A through 8F.

Figures 8A, 8B, 8C:
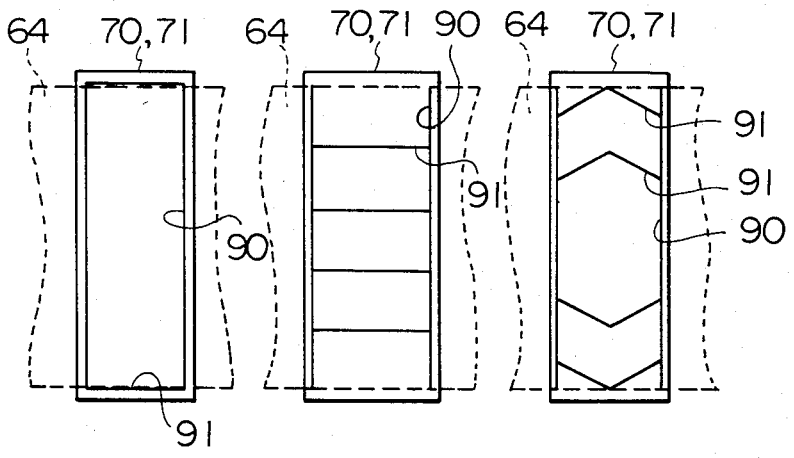
FIGS. 8A through 8F explanatorily shown different types of slit nozzles in the apparatus of the present invention.
Figures 8D, 8E, 8F:
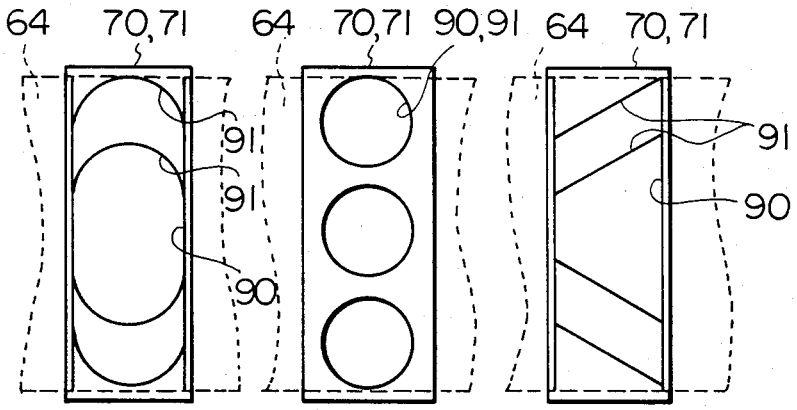

In FIG. 8A, the slit nozzle is in the form of a single closed rectangular channel. In FIG. 8B, the slit nozzle is composed of two lateral segments and three longitudinal segments, which are in the form of straight lines, and contains three closed rectangular channels. In FIG. 8C, the longitudinal segments 91 are in the form of hooked lines. In FIG. 8D, the longitudinal segments 91 are in the form of curved lines. In FIG. 8E, the slit nozzle is composed of three circle-shaped closed slits. In FIG. 8F, the longitudinal segments 91 are at angles to the longitudinal direction of the horizontal path of the metal strip.

Figure 9:
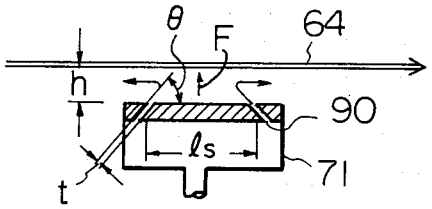
FIG. 9 is an explanatory longitudinal cross-sectional view of an embodiment of a static pressure liquid pad usable for the apparatus of the present invention.

In the static pressure liquid pad 71 indicated in FIG. 9, the width t and, the angle $\theta$ of the slits 90, and the distance $l_s$ between a pair of slits 90 are variable in accordance with the purpose of the apparatus. The distance h between the lower surface of the metal strip 64 and the upper surface of the pad 71 is an important factor relating to the force F for supporting the metal strip 64. This relationship between h and F will be illustrated hereinafter. Usually it is preferable that the width t be in the range of from 2 mm to 5 mm and the distance $l_s$ be in the range of from 100 mm to 400 mm.

Figure 10A:
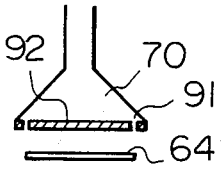
FIG. 10A is an explanatory lateral cross-sectional view of another embodiment of a static pressure liquid pad usable for the apparatus of the present invention.

A static pressure liquid pad 70 indicated in FIG. 10A is in the form of a reversed funnel and is provided with a bottom plate 92. A slit nozzle 91 is formed in the bottom plate 92.

Figure 10B:
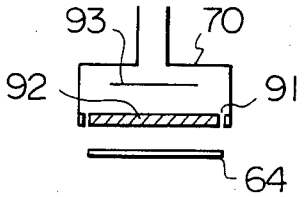
FIG. 10B is an explanatory lateral cross-sectional view of still another embodiment of a static pressure liquid pad usable for the apparatus of the present invention.

A static pressure liquid pad 70 indicated in FIG. 10B is in the form of a cubic box and is provided with a bottom plate 92 having a slit nozzle 91.

Usually, the bottom plate in the static pressure liquid pad may be made from an electroconductive material so as to be able to serve as an anode plate. Otherwise, the bottom plate may be made from an electrically insulating material.

If the bottom plate is electroconductive and serves as an anode plate, it is preferable that the slit nozzle formed in the bottom plate be in the form indicated in FIG. 8C, 8D, 8E, or 8F, wherein the longitudinal segments are in the form of a hooked line, a curve, a circle, or a line inclined from the longitudinal direction of the horizontal path of the metal strip.

Referring to FIG. 10B, a plate 93 for controlling the flows of the electrolytic treating liquid is located in the pad 70. This flow control plate 93 is effective for controlling the flow velocity of the electrolytic treating liquid ejected through the slit nozzle 91 to be uniform.

The inside volume of the static pressure liquid pad does not necessarily have to be so large as long as the inside volume is large enough to allow the pad to serve as a buffer tank of the electrolytic treating liquid to be ejected through the slit nozzle. Accordingly, the design of the static pressure liquid pad may be compact.

The functions and effects of the present invention will be explained below.

In the conventional electrolytic treatment of a metal strip using a horizontal type apparatus, there is a large problem in that the metal strip is curved downward due to the weight of the metal strip itself and the difference between the weight of a portion of the electrolytic treating liquid flowing above the metal strip and the weight of another portion of the electrolytic treating liquid flowing below the metal strip, thereby generating a catenary of the metal strip. This catenary causes that the reduction of distance between the upper and lower electrodes is limited.

In the present invention, the above-mentioned catenary problem can be eliminated by using the static pressure liquid pads. That is, the metal strip is stably supported in its horizontal path by the static pressures produced on the upper and lower surfaces of the metal strip.

Figure 11:
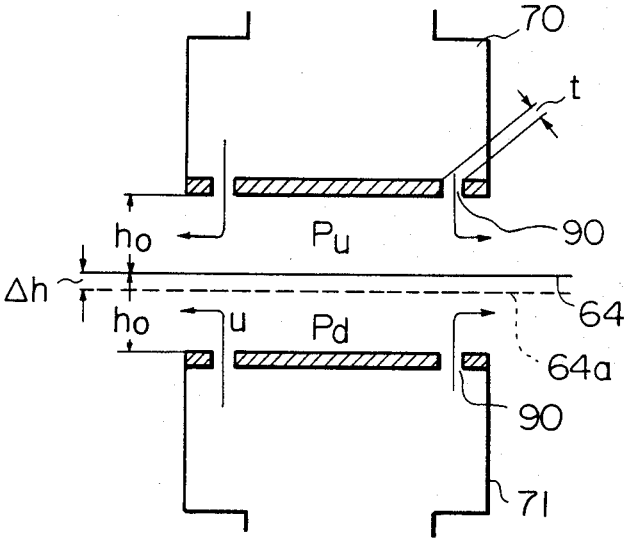
FIG. 11 is an explanatory longitudinal cross-sectional view of a pair of static pressure liquid pads usable for the apparatus of the present invention, for the purpose of illustrating the production of static pressure on a metal strip.

Referring to FIG. 11, a pair of static pressure liquid pads 70 and 71 face each other through a metal strip 64. Each pad is provided with a slit nozzle having slits 90. The width of the slits 90 is represented by t. An electrolytic treating liquid is ejected through the slit nozzles at a flow velecity U under pressure. The streams of the ejected liquid produce lower and upper static pressures Pd and Pu between the lower pad 71 and the metal strip 64 and between the upper pad 70 and the metal strip 64, respectively. When the distance between the lower pad and the metal strip is represented by $h_o$, and the density of the electrolytic treating liquid is represented by $\rho$, the lower and upper static pressures Pd and Pu can be calculated in accordance with the following equation:

$$Pd = Pu = \rho U^2 t(1/h_o)$$

When the metal strip is curved downward and the height of the resultant catenary of the metal strip is represented by h, the difference p between the lower static pressure Pd and the upper static pressure Pu is regulated by the following equation:

$$\Delta P = Pd - Pu = 2\rho U^2 t \cdot (1/h_o) \cdot \Delta h$$

That is, $$\Delta P = k \cdot \Delta h$$

The difference $\Delta P$ is proportional to the height $\Delta h$ of the catenary. That is, the larger the height $\Delta h$ of the catenary of the metal strip, the larger the pressure difference $\Delta P$ which produces a force which pushes upward the metal strip so as to place the metal strip in the center between the upper and lower pads.

In the process and apparatus of the present invention, the static pressure liquid pads are utilized so as to automatically center the metal strip in the treating space. The upper and lower static pressure liquid pads are located in the longitudinal middle portions of the upper and lower electrode devices, respectively.

Figure 12A:
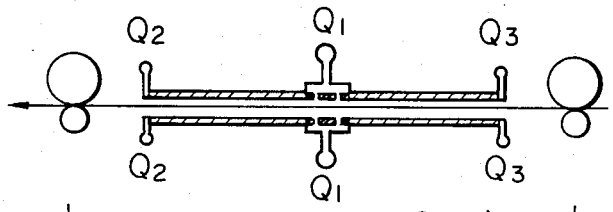
FIG. 12A is an explanatory longitudinal cross-sectional view of an embodiment of the apparatus of the present invention in which apparatus electrode devices are provided with lateral edge masks.
Figure 12B:
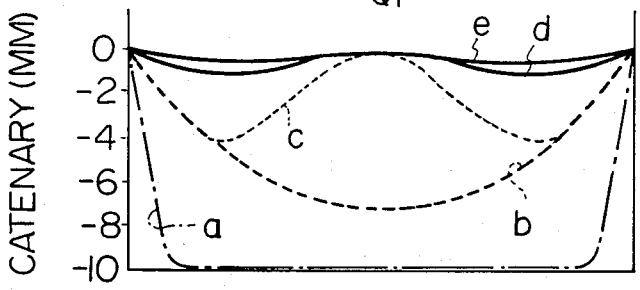
FIG. 12B shows catenary in mm of a metal strip moving from feeding rolls to delivery rolls through the electrode device indicated in FIG. 12A.

When a metal strip is treated in the apparatus of the present invention indicated in FIG. 12A, the static pressure applied to the metal strip and the catenary of the metal strip are in the relationship indicated in FIG. 12B.

In an experiment using the apparatus indicated in FIG. 12, the distance between a center of a pair of feeding rolls and a center of a pair of delivering rolls was 2500 mm, the tension applied to the metal strip was 0.72 kg/mm$^2$, the thickness of the metal strip was 0.4 mm, the width of the metal strip was 1000 mm, the slit nozzles were in the form indicated in FIG. 8B, and, referring to FIG. 9, $\theta = 90$ degrees, $t = 4$ mm, $l_s = 200$ mm, and $h = 10$ mm. The static pressure liquid pads were of the type indicated in FIG. 10A. The electrode devices were provided with lateral edge masks which were of a conventional type. The lateral edge masks were located 10 mm from the side edges of the metal strip. The width of the additional slit nozzles was 1.5 mm. The catenary of the metal strip was measured with a displacement meter. In FIG. 12B, the level of "0" in the ordinates corresponds to the center level of the treating space between the upper and lower electrode devices.

In FIG. 12B, Curve a shows a catenary of the metal strip when the strip was moved horizontally and treated with an electrolytic treating liquid without ejecting the liquid toward the metal strip. In this case, the metal strip is greatly curved downward due to the weight of the metal strip and the weight of the treating liquid on the metal strip. The height of the catenary was 10 mm or more. Accordingly, it is necessary that the electrode devices be spaced from each other to a large extent.

In FIG. 12B, Curve b shows a catenary of the metal strip due to the weight of the metal strip only. Curve c shows a catenary of the metal strip when streams of the electrolytic treating liquid were ejected upward toward the metal strip through the upper and lower static pressure liquid pads $Q_1$ only, each at a flow rate of 0.8 $m^3$/min. In this case, the distributions of static pressures applied to the upper surface and the lower surface of the metal strip are indicated by line $C_T$ and line $C_B$, respectively, in FIG. 12C.

Referring to Curve C in FIG. 12B, the metal strip was deformed to a W-shaped form and only a middle portion of the metal strip was centered by the static pressure produced by the liquid stream ejected through the pad $Q_1$. Therefore, the intensity of the catenary in Curve c is limited to 4 mm or less.

When a portion of the treating liquid was ejectd through the upper and lower pads $Q_1$ each at a flow rate of 0.8 $m^3$/min and another portion of the treating liquid was ejected through the upper and lower additional slit nozzles $Q_2$ and $Q_3$ each at a flow rate of 0.1 $m^3$/min, the catenary of the metal strip is shown by Curve d in FIG. 12B. In this case, the distributions of the static pressures produced on the upper and lower surfaces of the metal strip are shown by line $d_T$ and line $d_B$ in FIG. 12C.

When the same procedures as those described above were carried out except that the flow rate of the treating liquid ejected through each additional slit nozzle was changed to 0.2 $m^3$/min, the catenary of the metal strip is shown by Curve e in FIG. 12B.

Figure 12C:
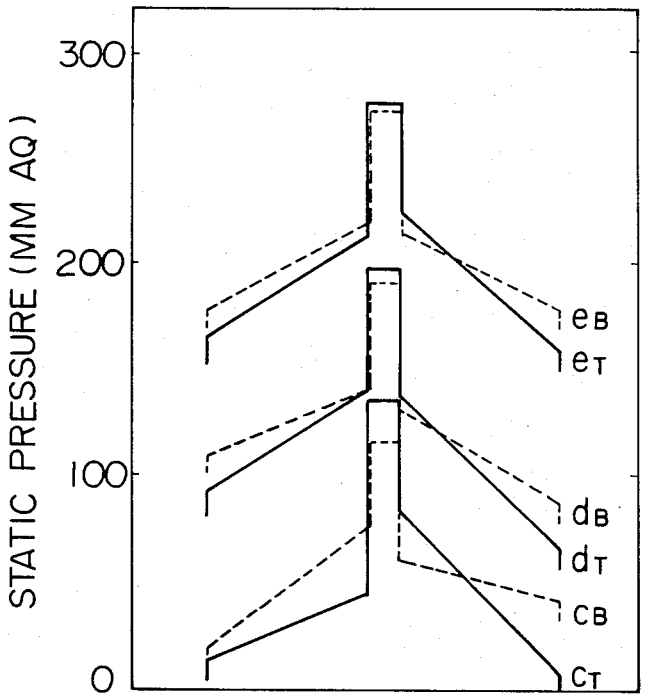
FIG. 12C shows static pressure created on upper and lower surfaces of a metal strip moving from the feeding rolls to the delivery rolls through the electrode devices indicated in FIG. 12A.

In this case, the distributions of the static pressures produced on the upper and lower surfaces of the metal strip are shown by line $e_T$ and line $e_B$ in FIG. 12C.

In FIG. 12C, Curve d showns that when the flow rate of the treating liquid ejected through the additional slit nozzles $Q_2$ and $Q_3$ was 0.1 $m^3$/min, the height of the catenary of the metal strip was 1 mm or less. Also, Curve e shows that when the above-mentioned flow rate was 0.2 $m^3$/min, the height of the catenary of the metal strip was 0.5 mm or less.

The above-mentioned phenomenon shows that the streams of the treating liquid ejected through the additional slit nozzles are effective for increasing the static pressures in the treating space and the increased static pressures are effective for promoting the centering effect on the metal strip.

Also, the above-mentioned phenomenon shows that it is impossible to satisfactorily decrease the catenary of the metal strip between the entire lengths of the electrode devices by using only the static pressure liquid pads located in the longitudinal middle portions of the electrode devices.

In the electrolytic treatment using the apparatus indicated in FIG. 3, the metal strip is supported by dynamic pressures of the streams of the treating liquid ejected from the slits located in the middles of the electrode devices. That is, the supporting force depends on the dynamic pressure of the ejected treating liquid stream. In this case, the dynamic pressure cannot satisfactorily center the metal strip.

In an experiment wherein the apparatus indicated in FIG. 3 was used, a treating liquid was ejected through the slits 40 and 41 each at a flow rate of 0.8 $m^3$/min, the entrance ends and the exit ends of the electrode devices were sealed with sealing plates 50, 51, 52, and 53, and the metal strip 34 was moved at a tension of 1 kg/$mm^2$, the largest height of the resultant catenary of the metal strip was 6 mm. In order to decrease the largest height of the catenary to 3 mm, it was necessary to increase the tension applied to the metal strip to a large value of 3 to 4 kg/$mm^2$.

In the present invention, however, the intensity of the catenary of the metal strip is very small even when the tension applied to the metal strip is very small. Also, it is easy to center the metal strip under a small tension by applying the static pressures to the metal strip. Furthermore, it is important that the streams of the treating liquid ejected through the additional slit nozzles which are located in the entrance and exit ends of the electrode devices be significantly effective for enhancing the supporting effects of the static pressures created by the static pressure liquid pads which are located in the middle portions of the electrode devices. This effect of the addtional slit nozzles is significantly contributory to decreasing the catenary of the metal strip.

Figure 13A:
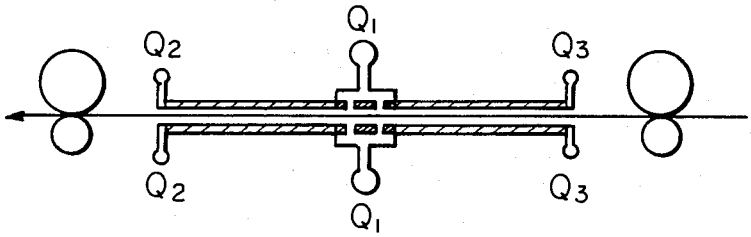
FIG. 13A is an explanatory longitudinal cross-sectional view of an embodiment of the apparatus of the present invention in which electrode devices are provided with no lateral edge masks.

In another experiment, an apparatus indicated in FIG. 13A was used. This apparatus was the same as that indicated in FIG. 12A, except that the electrode devices were not provided with lateral edge masks.

Figure 13B:
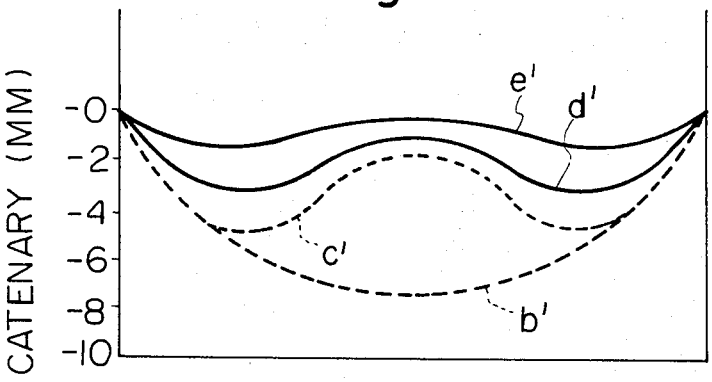
FIG. 13B shows catenary of a metal strip moving from feeding rolls to delivery rolls through the electrode devices indicated in FIG. 13A.

In the apparatus indicated in FIG. 13A, when an electrolytic treating liquid was ejected only through the static pressure liquid pads $Q_1$, the catenary of the metal strip was as indicated by Curve b' in FIG. 13B. The intensity of the catenary indicated by Curve b' is larger than that indicated by Curve b in FIG. 12B.

When the same procedures as those corresponding to Curves c, d, and e in FIG. 12B were carried out in the apparatus indicated in FIG. 13A, the resultant catenaries of the metal strip were as indicated by Curves c', d', and e' in FIG. 13B, respectively.

When comparing Curves c', d', and e' in FIG. 13B respectively with Curves c, d, and e in FIG. 12B, it is clear that the lateral edge masks in the electrode devices are effective for decreasing the catenary of the metal strip. However, FIG. 13B shows that the apparatus of the present invention having no lateral edge masks is still useful for actual electrolytic treatment.

In the process and apparatus of the present invention, the stream of the electrolytic treating liquid ejected through the slit nozzle in each static pressure liquid pad is divided into a concurrent flow and countercurrent flow to the movement of the metal strip in the treating space. The concurrent and countercurrent flows can be controlled to be uniform by the present invention. This effect of the present invention will be explained below.

Figure 14:
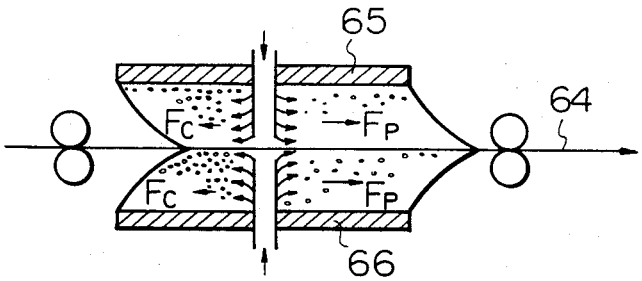
FIG. 14 is an explanatory view of flows of an electrolytic treating liquid ejected through upper and lower static pressure liquid pads each located in the center of the corresponding electrode device.

Referring to FIG. 14, a metal strip moves through a treating space formed between upper and lower electrode devices 65 and 66, and an electrolytic treating liquid is fed into the treating space through upper and lower slit nozzles located in the middle portions of the upper and lower electrode devices 65 and 61. Each stream of the treating liquid is divided into countercurrent flows $F_c$ and concurrent flows $F_p$ to movement of the metal strip 64. When the distance between each electrode device and the metal strip is small, the viscosity of the treating liquid highly influences the distribution of the flow viscosity of the flows of the treating liquid. That is, in the concurrent flows $F_p$, the closer the location of the flows to the metal strip, the larger the flow velocity of the flows. In the countercurrent flows $F_c$, the closer the location of the flows to the metal strip, the smaller the flow velocity of the flows. Therefore, the average flow velocity of the concurrent flows is larger than that of the countercurrent flows.

Especially, in the countercurrent flows in the upper treating gap, gas bubbles generated on the surface of the electrode are accumulated around the electrode surface. Also, in the countercurrent flows in the lower treating gap, gas bubbles generated on the surface of the electrode float up and are accumulated around the lower surface of the metal strip. Since the flow viscosity vector of the countercurrent flows $F_c$ is in the opposite direction to that of the movements of the metal strip, it is difficult to remove the accumulated gas bubbles. The amount of the accumulated gas bubbles becomes large with the increase in the velocity of the metal strip. Therefore, when the apparatus is operated at a high speed, it is difficult to make short the distance between each electrode device and the metal strip.

It should be noted that the flow velocity of the treating liquid flows located close to the upper surface of the metal strip is different from that located close to the lower surface of the metal strip. A portion of the treating liquid flowing in the upper gap flows down into the lower gap around the side edge of the metal strip. Therefore, both the flow rate and flow velocity of the flows around the lower surface of the metal strip are larger than those around the upper surface of the metal strip, in both the concurrent and countercurrent flow regions. Accordingly, for the purpose of producing a product having uniform surface quality, it is effective to decrease as much as possible the difference in the flow rate between the flows around the lower surface of the metal strip and that around the upper surface thereof. Also, by decreasing the difference, the removal of the gas bubbles becomes easy. Therefore, an undesirable increase in voltage due to the accumulated gas can be presented and unevenness in appearance of the product due to the accumulated gas can be eliminated.

For the above-mentioned reasons, in recent electrolytic treatment, for example, alloy plating, at a high speed at a high effeciency, it is important to control the flows of the electrolytic treating liquid in the treating space. In the apparatus indicated in FIG. 1, however, the flow velocity of the treating liquid in the areas surrounded by the closed slits is not sufficiently large. Therefore, the supply of the electrolyte to the metal strip and the removal of gas in the areas are unsatisfactory.

In the electrolytic treatment in accordance with Japanese Examined Patent Publication No. 50-8020, an electrolytic treating liquid is compulsorily recycled countercurrently to movement of a metal strip. This method is effective for increasing the possible critical current density. However, when the metal strip is moved at a high velocity, there is a possibility of decreasing the flow velocity of the treating liquid in the treating space, due to the high viscosity of the treating liquid. Also, when the length of the electrodes is large, it is difficult to remove gas generated around anodes and to uniformly supply electrolyte to the metal strip. Accordingly, in this case, it is necessary to feed the electrolytic treating liquid at a high flow rate. Also, critical current density is in the range of 50 to 100 $A/dm^2$.

In the apparatus indicated in FIG. 3, it is difficult to control the countercurrent and concurrent flows of the treating liquid in the treating space as to be equally balanced to each other. That is, in the concurrent flow side, the supply of the electrolyte and the removal of gas can be effected satisfactorily. However, in the diffusion layer $\delta$, the relative velocity of the treating liquid is poor. In the countercurrent flow side, it is difficult to satisfactorily effect the supply of the electrolyte and the removal of gas. The apparatus indicated in FIG. 3 is a highly improved one in comparison with other conventional apparatuses and allows the critical current density to increase. However, this type of apparatus should be further improved so that the operation can be carried out at a high flow velocity of the treating liquid even when the velocity of the metal strip is increased and the removal of gas from the countercurrent flows can be carried out easily.

The above-mentioned problems can be eliminated by the present invention wherein the flows of the electrolytic treating liquid in the treating space can be controlled by using the additional slit nozzle.

Figure 15:
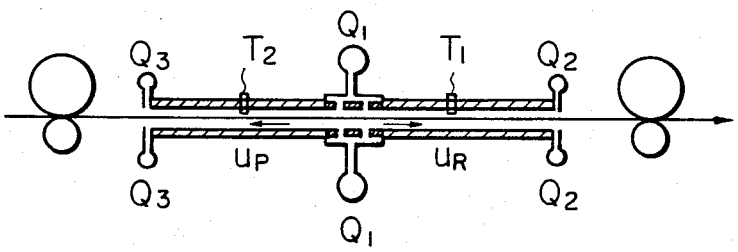
FIG. 15 is an explanatory longitudinal cross-sectional view of an embodiment of the apparatus of the present invention having flow velocity meters.

In an experiment, an apparatus indicated in FIG. 15 was used. In this apparatus, flow velocity meter $T_1$ and $T_2$ were arranged in an upstream portion and a downstream portion of a upper electrode device, respectively. The meter $T_1$ measured the flow velocity $U_p$ of the countercurrent flows to movement of the metal strip and the meter $T_2$ measured the flow velocity $U_R$ of the concurrent flows.

Figure 16:
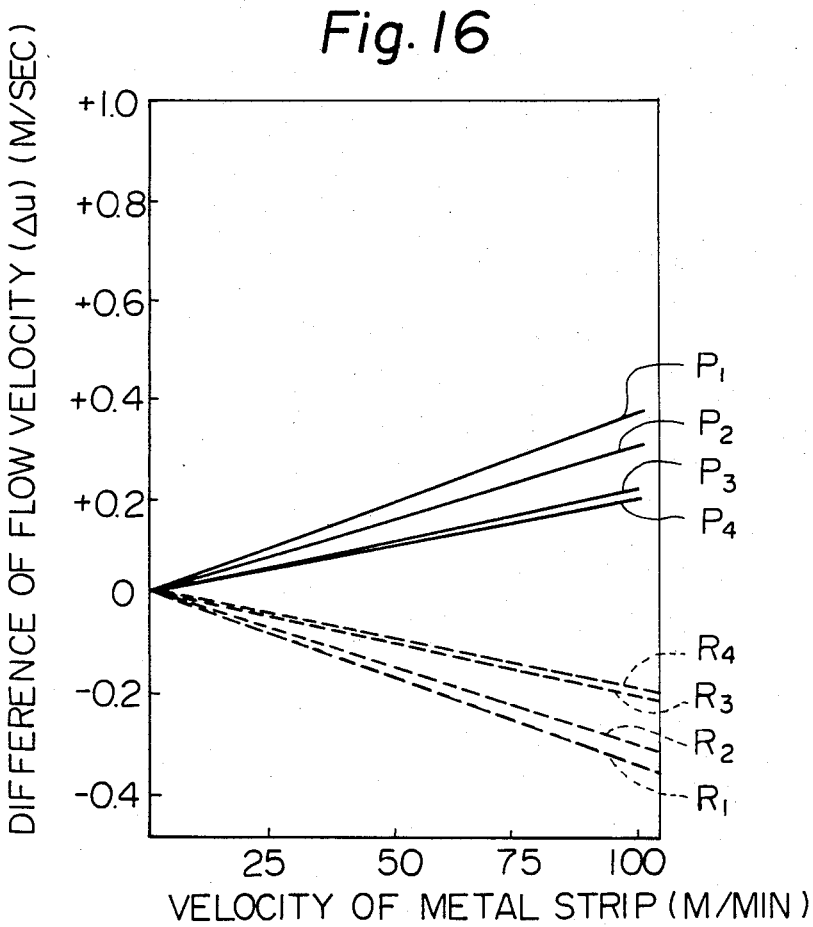
FIG. 16 shows a relationship between the velocity of a metal strip moving through the apparatus indicated in FIG. 15 and the difference in flow velocity of flows of an electrolytic treating liquid flowing through the apparatus.

The relationships between the velocity V of the metal strip and the flow velocities $U_P$ and $U_R$ are indicated in FIG. 16.

In FIG. 16, $P_1$, $P_2$, $P_3$, and $P_4$ represent concurrent flows and $R_1$, $R_2$, $R_3$, and $R_4$ represent countercorrent flows, $\Delta U$ represents a difference between a flow velocity $U_o$ of the treating liquid when the velocity of the metal strips is zero (0) and another flow velocity $U_i$ of the treating liquid when the velocity of the metal strip is 25, 50, 75, or 100 m/min.

The concurrent flow $P_1$ and the countercurrent flow $R_1$ were produced by using the apparatus indicated in FIG. 3 at a flow rate of 0.8 $m^3$/min. The concurrent flow $P_2$ and the countercurrent flow $R_2$, $P_3$ and $R_3$, and $P_4$ and $R_4$ were produced by using the apparatus of the present invention at a flow rate of the treating liquid ejected through each static pressure liquid pad $Q_1$ of 0.8 $m^3$/min. Both the flow rates of the treating liquid ejected through the additional slit nozzles $Q_2$ and $Q_3$ were zero (0) in the case of the flows $P_2$ and $R_2$, 0.1 $m^3$/min in the case of the flows $P_3$ and $R_3$, and 0.2 $m^3$/min in the case of the flows $P_4$ and $R_4$. FIG. 16 clearly shows that the difference in the flow velocity between the flow $P_1$ and the flow $R_1$ was very large. However, when the apparatus of the present invention was used, the difference in flow velocity between the countercurrent flows and the concurrent flows can be decreased by using the additional slit nozzle.

The same experiment as that mentioned above was carried out, except that the electrodes were replaced by clear acrylic resin plates and tufts were fixed to the plates to observe the flows of the treating liquid. It was confirmed by observation that the difference in flow velocity between the concurrent and countercurrent flows becomes small by controlling the flow rate of the treating liquid ejected through the additional slit nozzles. Also, it was confirmed that the stream of the treating liquid ejected through the static pressure liquid pads can be divided equally to the concurrent and countercurrent flows by separately controlling the flow rates of the treating liquid in the additional slit nozzles, in consideration of the velocity of the metal strip. For example, when the velocity of metal strip was 100 m/min, a satisfactory result was obtained by adjusting the flow rate in the pads $Q_1$ to 0.8 $m^3$/min, the flow rate in the additional slit nozzle $Q_2$ (concurrent flow side) to 0.2 $m^3$/min, and the flow rate in the additional slit nozzle $Q_3$ (counter current flow side) to zero.

The above-mentioned flow-dividing effect of the present invention is due to the following facts.

That is, when the treating liquid is ejected through the static pressure liquid pad located in the longitudinal middle portion of the electrode device, the ejected streams of the treating liquid form walls of the treating liquid in each treating gap. The walls are effective for shutting out the flows of the treating liquid accompanying movement of the metal strip in the countercurrent flow region. Also, a stream of the treating liquid ejected through the additional slit nozzle located in the exit end of the electrode device serves as a wall for shutting out flows of the treating liquid accompanying movement of the metal strip in the concurrent flow region. Accordingly, the flow rates of the treating liquid in the concurrent and countercurrent flow regions can be controlled so that the difference in the flow rate between the above-mentioned two regions becomes very small or zero. Therefore, the flow velocities in the countercurrent and concurrent flow regions can be controlled to be similar to each other.

For the purpose of effective control of the flow velocities in the countercurrent and concurrent flow regions, the locations of the static pressure liquid pads may be shifted from the centers to the exit or entrance end sides of the electrode devices. For example, when the velocity of the metal strip is very high, it is preferable that the locations of the static pressure liquid pads be between the centers and the entrance ends of the electrode devices so that the length of the countercurrent flow regions is smaller than that of the concurrent flow regions. This is effective for adjusting the flow velocities in both the countercurrent and concurrent flow regions so as to be equal to each other.

In the present invention, the entrance and exit ends of the electrode device are sealed by ejecting a portion of the treating liquid toward the metal strip. This feature is effective for decreasing the distance between each electrode device and the metal strip, for controlling the flows of the treating liquid in the treating space, for removing gas from the treating space, and for preventing contamination of air into the treating liquid.

Figure 17A:
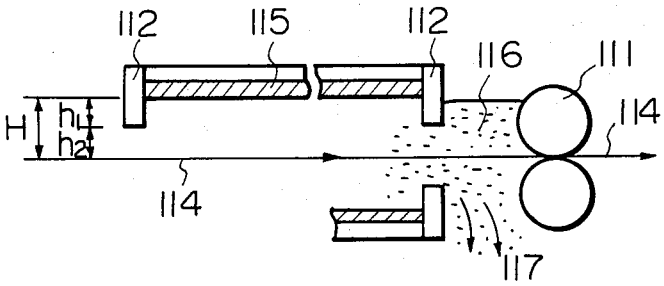
Fig. 17A PRIOR ART
FIG. 17A is an explanatory longitudinal cross-sectional partial view of a conventional apparatus having edge masks located in the entrance and exit ends of electrode devices.

In the conventional apparatus indicated in in FIG. 17A, wherein an electrode device 115 is provided with entrance and exit end sealing plates 112 which project toward the metal strip 114, the distance H between the electrode 115 and the metal strip is the sum of the length $h_1$ of the projection of the sealing plate 112 and the distance $h_2$ between the end of the sealing plate 112 and the metal strip 114. The sealing effect depends on the length $h_1$ of the sealing plate. Therefore, even if it is desired to make small the distance H so as to avoid contact of the metal strip with the electrode to decrease the catenary of the metal strip and to prevent the C-shape deformation of the metal strip and the surge-deformation of edge portion of the metal strip, the decrease in the distance H is restricted by the necessary length $h_1$ of the sealing plate.

Figure 17B:
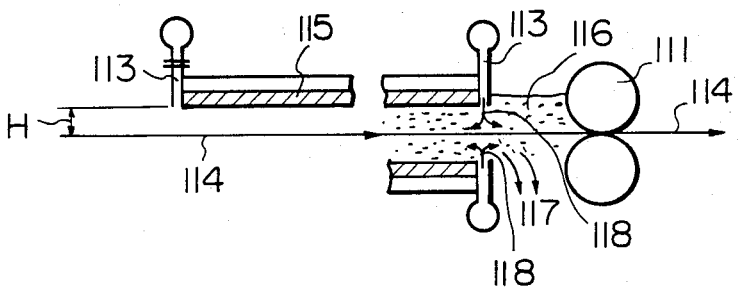
FIG. 17B is an explanatory longitudinal cross-sectional partial view of an embodiment of the apparatus of the present invention wherein the electrode devices are provided with additional slit nozzles located in the entrance and exit ends thereof.

In the apparatus of the present invention indicated in FIG. 17B, the distance H can be adjusted without considering the length of the sealing plate. That is, it is possible to decrease the distance H in accordance with the purpose of the apparatus.

In the conventional apparatus indicated in FIG. 17A, a portion 116 of the treating liquid above the metal strip 114 is dammed up by the delivering rolls 111 and flows laternally toward the side edges of the metal strip. However, another portion 117 of the treating liquid below the metal strip 114 can freely fall down through the sealing plate 117. Therefore, the pressure of the portion of the treating liquid on the metal strip becomes higher than that of the portion of the treating liquid below the metal strip. Due to this phenomenon, a portion of the treating liquid above the metal strip flows down into the lower gap around the side edges of the metal strip and causes the flows of the treating liquid in the lower gap to be disturbed.

In the apparatus of the present invention indicated in FIG. 17B, the portions of the treating liquid above and below the metal strip are sealed by the streams 118 of the treating liquid ejected through the additional slit nozzles 113. Therefore the pressures of the portions of the treating liquid above and below the metal strip are maintained equal to each other. This feature is effective for restricting the invasion of a portion of the treating liquid from the upper gap into the lower gap.

In FIGS. 18A-(a) through 18B-(c), the functions of the additional slit nozzle in the apparatus of the present invention are shown in comparison with those of the sealing plates in the conventional apparatus.

Referring to FIG. 18A-(a), the flows of the treating liquid are disturbed by the sealing plate. Referring to FIG. 18B-(a), however, the flows of the treating liquid are not effected by the stream of the treating liquid ejected through the additional slit nozzle.

Referring to FIG. 18A-(b), the sealing plate hinders the removal of gas so as to allow the gas to be accumulated around the seating plate. This accumulated gas also violates the flows of the treating liquid. Referring to FIG. 18B-(b), however, the gas generated in the treating liquid can be easily removed.

Referring to FIG. 18A-(a), in the entrance portion of the electrode device in which the treating liquid flows countercurrently to movement of the metal strip, the flow velocity of the treating liquid flowing along the surface of the metal strip is highly affected by the velocity of the metal strip. That is, in this entrance portion, the larger the velocity of the metal strip, the smaller the flow velocity of the treating liquid. This phenomenon sometimes results in the entrance portion becoming not filled by the treating liquid and allows contamination by air. This phenomenon frequently occurs when the velocity of the metal strip is 100 m/min or more. Referring to FIG. 18B-(c), however, the entrance portion is always filled by the treating liquid even if the metal strip is moved at a high velocity.

For example, when the sealing plates are used, the problem of not filling the entrance portion with the treating liquid occurs at the velocity of the metal strip of 180 m/min or more. When the treating liquid is ejected vertically through an additional slit nozzle wherein t is 1.5 mm and the flow velocity is 1.5 m/sec, the above-mentioned problem does not occur at the velocity of the metal strip of 300 m/min or less. It becomes possible to effect the treatment at a velocity of the metal strip of more than 300 m/min by controlling the angle of the additional slit nozzle and the flow rate and flow velocity of the treating liquid ejected through the additional slit nozzle.

In the present invention, the flow velocity of the treating liquid in the treating space can be controlled by varying the angle of the slits in the slit nozzle in the static pressure liquid pad.

As indicated in FIGS. 4, 9, and 11, the lateral slits may be directed at right angles to the horizontal path of the metal strip or at angles inclined from the horizontal path of the metal strip toward the middle of the pad.

Figure 19A:
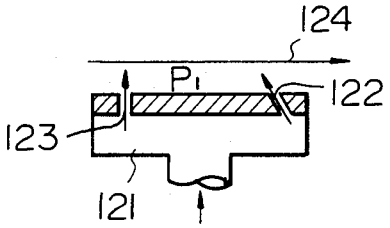
FIG. 19A is an explanatory longitudinal cross-sectional view of an embodiment of the static pressure liquid pad usable for the present invention.
Figure 19B:
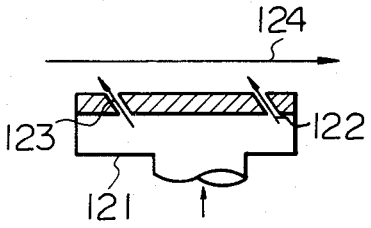
FIG. 19B is an explanatory longitudinal cross-sectional view of another embodiment of the static pressure liquid pad usable for the present invention.

When the metal strip is moved at a very high velocity and the distance between the electrode device and the metal strip is small, the slit nozzles indicated in FIGS. 19A and 19B are effective for controlling the flow velocities of the treating liquid in the upper and lower gaps to be substantially equal to each other.

In FIG. 19A, a lateral slit 123 located in the entrance side is directed at right angles to the metal strip 124, and another lateral slit 122 located in the exit side is inclined from the direction at right angles to the metal strip 124 toward the middle of the pad 121. In this case, the streams of the treating liquid ejected through the lateral slits 122 and 123 produce a static pressure $P_1$ in the space surrounded by the curtains of the streams between the pad 121 and the metal strip 124.

In FIG. 19B, both lateral slits 122 and 123 in the pad 121 are inclined in the opposite direction to movement of the metal strip. This type of lateral slits is useful for treatment in which the metal strip velocity is higher than that in the apparatus indicated in FIG. 19A and/or the distance between the electrodes and the metal strip is smaller than that in FIG. 19A.

In the apparatuses indicated in FIGS. 19A and 19B, the inclined lateral slits are effective for increasing the flow rate of the treating liquid into the countercurrent flow region, so as to make the flow velocities of the treating liquid in the countercurrent and concurrent flow regions substantially equal to each other. Even if the lateral slits are inclined, it is possible to produce a static pressure high enough for stably supporting the metal strip.

According to the present invention, it becomes possible to decrease the distance between the electrode devices and the metal strip to 15 mm or less, preferably, 7 mm or less, which could not be attained by the conventional apparatuses without decreasing the stability of the process.

Also, it becomes possible, even at a line speed of 100 m/min or more, for the process of the present invention to be carried out without difficulty. Especially, the process of the present invention can be carried out even at an extremely high line speed of 300 m/min or more.

Furthermore, the process and apparatus of the present invention by using it becomes possible to carry out the electrolytic treatment of the metal strip at a high current density of 100 A/dm$^2$, especially, 200 A/dm$^2$ or more, under a low voltage, without generating burnt deposit and other defects on the surface of the product and without causing a rapid increase of voltage.

The following specific examples are presented for the purpose of clarifying the present invention. However, it should be understood that these are intended only to be examples of the present invention and are not intended to limit the scope of the present invention in any way.

EXAMPLE 1

Electrolytic treatment of a steel strip was carried out using an apparatus indicated in FIGS. 4 through 7, in which apparatus static pressure liquid pads used had a longitudinal cross-sectional profile indicated in FIG. 9 and a lateral cross-sectional profile indicated in FIG. 10B and slit nozzles used had a form indicated in FIG. 8B.

In the apparatus, the distance between the feeding rolls and the delivering rolls was 2500 mm and sealing edge masks indicated in FIGS. 5 and 6 were located in the treating space. Each edge mask was placed at a location 10 mm from the corresponding side edge of the steel strip.

In the slit nozzle, referring to FIG. 9, the angle of the lateral slit segments was 45 degrees, the width of the slits was 4 mm, and the distance $l_s$ between a pair of the lateral slit segments 200 mm.

In the additional slit nozzles, the width of the slit was 1.5 mm.

The electrolytic treatig liquid used was a conventional acid zinc-plating liquid.

In the electrolytic treatment procedures, a steel strip having a thickness of 0.4 mm and a width of 1000 mm was introduced into the treating space at a line speed of 100 m/min under a tension of 0.72 Kg/mm$^2$. The treating liquid was ejected at a flow rate of 0.8 m$^3$/min through each of the upper and lower slit nozzles and at a flow rate of 0.2 m$^3$/min through each of the additional slit nozzles.

The treatment procedures were repeated at each of distances of 5, 7.5, 10, and 15 mm between the electrode devices. In each care, the height of catenary of the steel strip did not exceed 1 mm.

Figure 20:
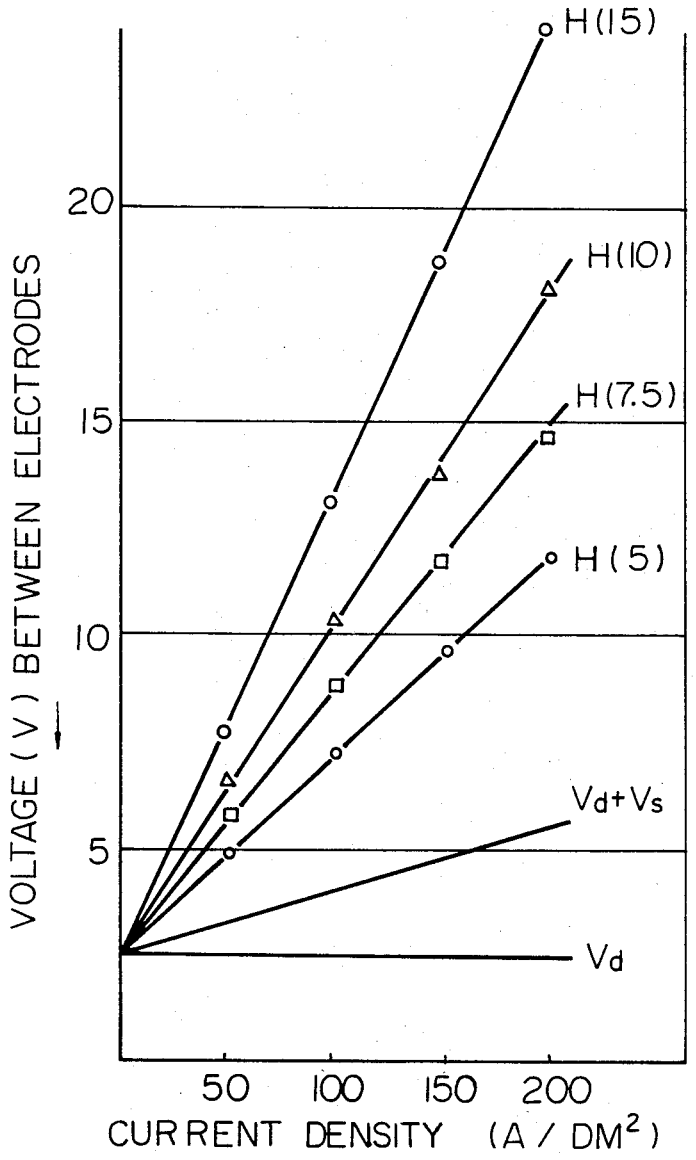
FIG. 20 shows a relationship of current density applied to electrolytic treatment and voltage created between electrodes in various distances between the electrodes.

FIG. 20 shows the relationships among the distances between the electrode devices, voltages between the electrodes, and current densities.

In FIG. 20, $V_s$ represents a voltage generated due to the resistance of the steel strip, and $V_d$ represents a decomposition voltage of the treating liquid. Also, in FIG. 20, H(5), H(7.5), H(10), and H(15) respectively represent voltages when the distances between the electrode devices were 5 mm, 7.5 mm, 10 mm, and 15 mm.

It has previously been believed difficult to carry out electrolytic treatment at a high current density of 200 A/dm$^2$ by using the conventional process and apparatus. However, FIG. 20 clearly shows that the electrolytic treatment in accordance with the present invention can be carried out at the high current density of 200 A/dm$^2$ without difficulty. This is true even in the case where the distance between electrode devices is very small, for example, 7.5 mm or 5 mm. That is, in the process and apparatus of the present invention, no irregular increase in voltage due to undesirable accumulation of gas in the treating space was found during the treating procedure. Also, the resultant products had no burnt deposits. Also, it was confirmed that since the catenary of the steel strip in the treating space was very small due to the fact that the steel strip was stably supported by the static pressures applied thereon, the treatment procedure could be smoothly carried out at a high current density of 200 A/dm$^2$ under a low voltage of 12 volts even when the distance between the electrode was very small, for example, 7.5 mm or 5 mm.

EXAMPLE 2

The same procedures as those described in Example 1 were carried out except for the distance between the electrodes was 7 mm.

Figure 21A:
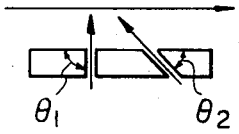
FIGS. 21A through 21E are explanatory longitudinal cross-sectional views of lower static pressure liquid pads in which slit nozzles are formed in different directions from each other.
Figure 21B:
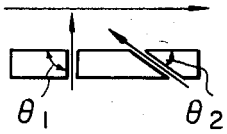
Figure 21C:
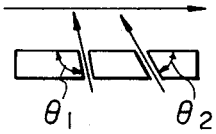
Figure 21D:
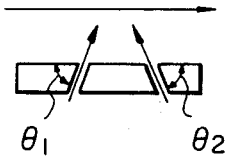
Figure 21E:
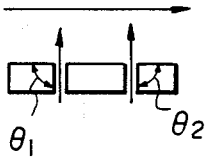

The treatment procedures were repeated using different types of slit nozzles indicated in FIG. 21A through 21E. In FIG. 21A, the angle $\theta_1$ of a lateral segment of slit located in the entrance side of the pad was 90 degrees and the angle $\theta_2$ of another lateral segment of slit located in the exit side of the pad was 45 degrees. In FIG. 21B, $\theta_1=90$ degrees and $\theta_2=30$ degrees. In FIG. 21C, $\theta_1=60$ degrees and $\theta_2=45$ degrees. In FIG. 21D, $\theta_1=45$ degrees and $\theta_2=45$ degrees. In FIG. 21E, $\theta_1=90$ degrees and $\theta_2=90$ degrees.

In each case of the slit nozzles, a proportion (%) of the flow rate of the countercurrent flows to the entire flow rate of the treating liquid ejected through each slit nozzle was measured. The results of the measurements are indicated in FIG. 22.

Figure 22:
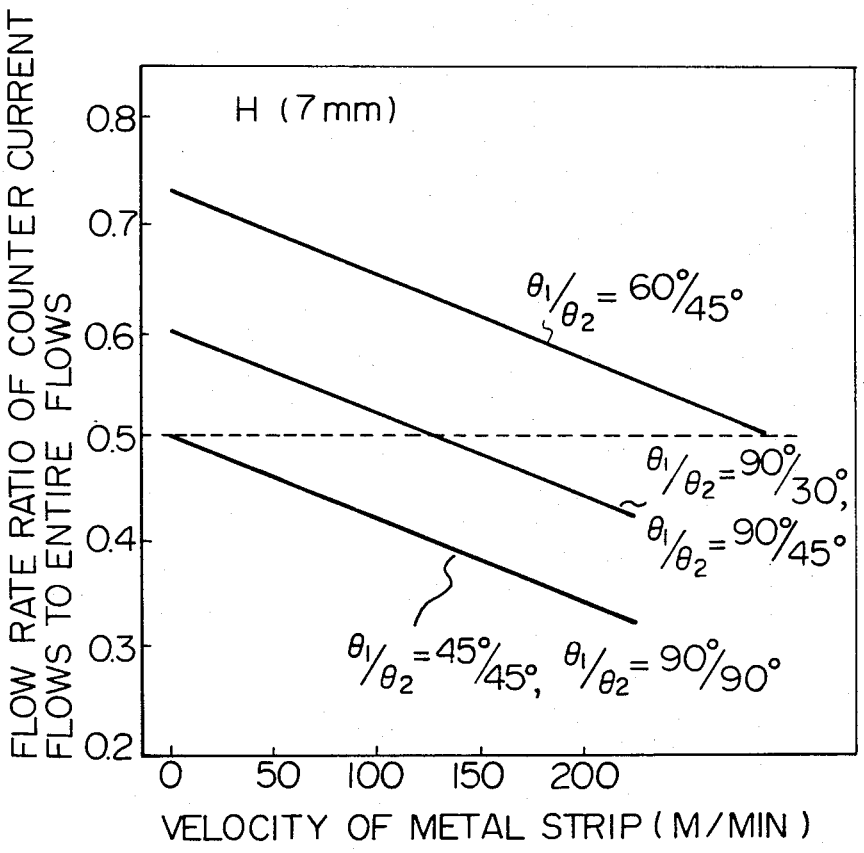
FIG. 22 shows a relationship between the velocity of a metal strip and flow rate ratio of counter flow to entire flow when the static pressure liquid pads of the types indicated in FIGS. 21A through 21E are used.

FIG. 22 shows that when the velocity of the metal strip was low, the flow rate ratio of the countercurrent flows to the entire flows was generally 0.5 or more. That is, the flow rate of the countercurrent flows is larger than that of the concurrent flows. However, with an increase in the velocity of the metal strip, the flow rate ratio of the countercurrent flows to the entire flows decreased. Each line in FIG. 20 reaches the flow rate ratio of 0.5 at a certain velocity of the metal strip. In this case, the flow rates of the concurrent and countercurrent flows become equal to each other. That is, it is possible to adjust the flow rates of the concurrent and countercurrent flows equal to each other by controlling the angles $\theta_1$ and $\theta_2$ of the lateral segments of slit to adequate values.

FIG. 22 also shows that when at least the lateral segment of slit located in the exit side of the pad is inclined toward the entrance side of the pad and the other lateral segment of slit in the entrance side of the pad is directed at right angles to the horizontal path of the metal strip or is inclined toward the entrance side of the pad, it becomes possible to divide the stream of the treating liquid ejected through the slit nozzle substantially equally into concurrent flows and countercurrent flows to movement of the metal strip, even when the velocity of metal strip is very high, for example, 200 m/min.

We claim:

1. A process for the continuous electrolytic treatment of a metal strip with an electrolytic treating liquid, which comprises the steps of:

introducing a metal strip along a horizontal path of movement thereof, into a narrow treating space formed between a pair of horizontal electrode devices spaced from and facing each other, each electrode device having an electrode and a static pressure liquid pad located in said electrode wherein each static pressure liquid pad is provided with a slit nozzle having at least one opening in the form of a closed channel;

ejecting first streams of said electrolytic treating liquid through said slit nozzles toward said metal strip surfaces to form at least one stream in the form of a closed curtain wall in the gap between the static pressure liquid pad and the metal strip surface, to fill the space surrounded by each closed curtain wall with the ejected electrolytic treating liquid and to cause a static pressure of said ejected electrolytic treating liquid to be created in each surrounded space to an extent that said metal strip is supported in said horizontal path thereof; and applying voltage between said metal strip and said electrodes; and which process is characterized in that the ejecting of the first streams of the treating liquid through each closed channel slit nozzle is carried out in the longitudinal central portion of the corresponding electrode devices, and additional streams of said electrolytic treating liquid are ejected toward said metal strip surface through additional slit nozzles located at the entrance ends and the exit ends of said pair of electrode devices and each extending in a direction lateral to the longitudinal direction of said horizontal path of movement of said metal strip, whereby the first streams of said electrolytic treating liquid ejected from said closed channel slit nozzles are confined in the spaces between said electrode devices and said metal strip.

2. The process as claimed in claim 1, wherein the lateral flows of said electrolytic treating liquid from said treating space are restricted by means for restricting the flow of liquid, located in both the lateral edge portions of each electrode device, the location of said means being adjacent to the side edges of said metal strip in said horizontal path thereof.

3. The process as claimed in claim 1, wherein said first stream of the electrolytic treating liquid ejected through said slit nozzle in said static pressure liquid pad is provided with at least one pair of longitudinal segments thereof located symmetrically about the longitudinal center line of and extending longitudinal to the longitudinal direction of said horizontal path of said metal strip and at least one pair of lateral segments thereof extending lateral to the longitudinal direction of said horizontal path of said metal strip and connected to said longitudinal segments to form said closed curtain wall.

4. The process as claimed in claim 3, wherein one of said pair of lateral segments of said stream of electrolytic treating liquid is located in the entrance end side of each static pressure liquid pad and is directed vertically toward the corresponding metal strip surface, and the other one of said pair of lateral segments is located in the exit end side of each static pressure liquid pad and is directed toward the corresponding metal strip surface at angles inclined along the opposite direction to that of movement of said metal strip.

5. The procss as claimed in claim 3, wherein all of said pair of lateral segments of said stream of said electrolytic treating liquid are directed at angles inclined in the opposite direction to that of movement of said metal strip.

6. The process as claimed in claim 1, wherein said metal strip is moved at a velocity of 100 m/min or more.

7. The process of claimed in claim 6, wherein said moving velocity of said metal strip is 300 m/min or more.

8. The process as claimed in claim 1, wherein when said voltage is applied, the current density in said electrolytic treating liquid between each electrode and said metal strip is 100 $A/dm^2$ or more.

9. The process as claimed in claim 8, wherein said current density is 200 $A/dm^2$ or more.

10. The process as claimed in claim 1, wherein said electrolytic treatng liquids in said treating space is collected and recycled to said supply source of said electrolytic treating liquid.

11. The process as claimed in claim 1, wherein the distance between each electrode device and the corresponding metal strip surface is 15 mm or less.

12. The process as claimed in claim 11, wherein said distance between each electrode device and the corresponding metal strip surface is 7 mm or less.

13. The process as claimed in claim 1, wherein the flow velocities of a portion of said electrolytic treating liquid flowing through the space between each electrode device and the corresponding metal strip surface in the same direction as that of movement of said metal strip and of another portion of said electrolytic treating liquid flowing in the opposite direction to that of movement of said metal strip are controlled to be similar to each other.

14. An apparatus for the continuous electrolytic treatment of a metal strip with an electrolytic treating liquid, which comprises:

means for a feeding a metal strip;

means for delivering said metal strip, which means is arranged downstream of said feeding means in such a manner that a horizontal path of movement of said metal strip is provided between said feeding means and said delivering means;

a pair of electrode devices spaced from and facing each other through said horizontal path of said metal strip and each extending in parallel to said horizontal path, each electrode device having an electrode and a static pressure liquid pad located in said electrode, each static pressure liquid pad being provided with a slit nozzle for ejecting therethrough an electrolytic treating liquid toward the corresponding metal strip surface, and said slit nozzle having at least one opening in the form of a closed channel and allowing a stream of the electrolytic treating liquid ejected through each opening to be formed in the form of a closed curtain wall in the gap between the metal strip surface and the corresponding electrode device and a static pressure of said electrolytic treating liquid to be created in the space surrounded by each closed curtain wall of the treating liquid to an extent that said metal strip is supported in said horizontal path thereof;

a source for supplying said electrolytic treating liquid to each slit nozzle; and means for applying voltage between said electrodes and metal strip;

which apparatus is characterized in that an additional slit nozzle is arranged at each of the entrance ends and the exit ends of said pair of electrode devices, each additional slit nozzle extending in a direction lateral to the longitudinal direction of said horizontal path and each additional slit nozzle being directed to the corresponding metal strip surface and being connected to said electrolytic treating liquid-supplying source.

15. The apparatus as claimed in claim 14, wherein each closed channel slit nozzle is located in the longitudinal central portion of the corresponding electrode device.

16. The apparatus as claimed in claim 14, wherein each static pressure liquid pad is located between the longitudinal center and said entrance end of the corresponding electrode device.

17. The apparatus as claimed in claim 14, wherein each of said electrode devices is provided with means for restricting the lateral flow of said electrolytic treating liquid between said electrode device and the corresponding metal strip surface, the locations of said restricting means being at both the lateral edge portions of said electrode device and adjacent to the side edges of said metal strip in said horizontal path thereof.

18. The apparatus as claimed in claim 17, wherein said restricting means is an edge plate vertically projecting from said lateral edge portion toward said horizontal path of said metal strip.

19. The apparatus as claimed in claim 17, wherein said restricting means is a further additional slit nozzle for vertically ejecting a portion of said electrolytic treating liquid toward said horizontal path of said metal strip.

20. The apparatus as claimed in claim 14, wherein each of said slit nozzles in said static pressure liquid pads is provided with at least one pair of longitudinal segments of slit located symmetrically about the longitudinal center line of and extending longitudinal to the longitudinal direction of said horizontal path of said metal strip, and at least one pair of lateral segments of slit extending lateral to the longitudinal direction of said horizontal path of said metal strip and connected to said longitudinal segments to form said at least one closed channel-formed opening.

21. The apparatus as claimed in claim 20, wherein said lateral segments of slit in each slit nozzle are directed vertically toward said horizontal path of said metal strip.

22. The apparatus as claimed in claim 20, wherein one of said pair of lateral segments of slit in each slit nozzle is located in the entrance end side of said static pressure liquid pad and is directed in angles inclined along the same direction as that of movement of said metal strip toward said horizontal path, and the other one of said pair of lateral segments of slit is located in the exit end side of said static pressure liquid pad and is directed in angles inclined along the opposite direction to that of movement of said metal strip toward said horizontal path.

23. The apparatus as claimed in claim 20, wherein one of said pair of lateral segments of slit in each slit nozzle is located in the entrance end side of said static pressure liquid pad and is directed vertically toward said horizontal path of said metal strip, and the other one of said pair of lateral segments of slit is located in the exit end side of said static pressure liquid pad and is directed toward said horizontal path in angles inclined along the opposite direction to that of movement of said metal strip.

24. The apparatus as claimed in claim 20, wherein all said lateral segments of slit in each slit nozzle are directed toward said horizontal path of said metal strip at angles inclined in the opposite direction to that of movement of said metal strip.

25. The apparatus as claimed in claim 14, wherein said electrodes consist of metallic material insoluble in said electrolytic treating liquid.

26. The apparatus as claimed in claim 14, wherein each static pressure liquid pad is provided with a surface layer thereof facing said horizontal path of said metal strip and consisting of an electroconductive material.

* * * * *

UNITED STATES PATENT AND TRADEMARK OFFICE

CERTIFICATE OF CORRECTION

PATENT NO. : 4,491,506

DATED : January 1, 1985

INVENTOR(S) : K. Sakai; H. Nakano

It is certified that error appears in the above-identified patent and that said Letters Patent is hereby corrected as shown below:

Column 7, line 67, change "8 and 9" to --18 and 19--.

Column 11, line 56, change "slits" to --slit nozzles--.

Column 24, line 53, change "procss" to --process--.

Signed and Sealed this

*Sixth* Day of *August 1985*

[SEAL]

*Attest:*

DONALD J. QUIGG

*Attesting Officer* *Acting Commissioner of Patents and Trademarks*